US012369665B2

(12) United States Patent
Wali

(10) Patent No.: US 12,369,665 B2
(45) Date of Patent: Jul. 29, 2025

(54) KNIT BRIM AND USES THEREOF

(71) Applicant: Hashim Wali, Watertown, MA (US)

(72) Inventor: Hashim Wali, Watertown, MA (US)

( * ) Notice: Subject to any disclaimer, the term of this patent is extended or adjusted under 35 U.S.C. 154(b) by 13 days.

(21) Appl. No.: 17/615,251

(22) PCT Filed: May 29, 2020

(86) PCT No.: PCT/US2020/035117
§ 371 (c)(1),
(2) Date: Nov. 30, 2021

(87) PCT Pub. No.: WO2020/243427
PCT Pub. Date: Dec. 3, 2020

(65) Prior Publication Data

US 2022/0232922 A1 Jul. 28, 2022

Related U.S. Application Data

(60) Provisional application No. 62/855,023, filed on May 31, 2019.

(51) Int. Cl.

| | |
|---|---|
| ***A42B 1/0184*** | (2021.01) |
| ***A42B 1/008*** | (2021.01) |
| ***A42B 1/22*** | (2006.01) |
| ***A42B 1/242*** | (2021.01) |

(52) U.S. Cl.
CPC ..... *A42B 1/0184* (2021.01); *A42B 1/008* (2013.01); *A42B 1/22* (2013.01); *A42B 1/242* (2013.01)

(58) Field of Classification Search
CPC ..... A42B 1/0184; A42B 1/0185; A42B 1/002; A42B 1/004; A42B 1/008; A42B 1/04; A42B 1/205; A42B 1/22; A42B 1/24; A42B 1/041; A42B 1/206; A42B 1/046; A42B 1/0186; A41D 20/00
See application file for complete search history.

(56) References Cited

U.S. PATENT DOCUMENTS

| | | | | |
|---|---|---|---|---|
| 164,573 A * | 6/1875 | Marks | A42B 1/046 | 2/173 |
| 882,648 A * | 3/1908 | Neugass | A42B 1/205 | 2/171.1 |
| 978,048 A * | 12/1910 | Monoson | A42C 5/02 | 2/209.12 |

(Continued)

FOREIGN PATENT DOCUMENTS

| | | |
|---|---|---|
| CA | 2088946 A1 * | 8/1994 |
| CA | 2876419 A1 | 7/2015 |

OTHER PUBLICATIONS

International Preliminary Report on Patentability in International Application No. PCT/US2020/035117, dated Dec. 9, 2021, 9 pages.

(Continued)

*Primary Examiner* — Heather Mangine
(74) *Attorney, Agent, or Firm* — DLA Piper LLP US; Dennis J. Parad

(57) ABSTRACT

Disclosed herein is a brim set for a knit hat, which can include an adjustable strap in a circular shape configured to be placed inside the knit hat, a brim attachment, and a connector to connect the brim attachment onto the adjustable strap. Also disclosed herein is a knit hat including the brim set, and a method of making a knit hat using the brim set.

14 Claims, 29 Drawing Sheets

(56) References Cited

U.S. PATENT DOCUMENTS 1,481,541 A * 1/1924 Douglas ..... A42B 1/0187 2/172
1,915,092 A * 6/1933 Hendrickson ..... A42B 1/04 D2/886
2,143,265 A * 1/1939 Goldstein ..... A42B 1/0186 2/209.12
2,181,446 A * 11/1939 Ames ..... A42B 1/0184 2/171.4
2,640,239 A * 6/1953 Schneider ..... A41F 1/008 24/134 P
2,714,269 A * 8/1955 Stafford ..... A63H 33/062 59/900
2,735,110 A * 2/1956 Baker ..... A42B 1/06 2/209.12
2,845,672 A * 8/1958 Molene ..... A44C 5/2057 24/116 R
2,900,696 A * 8/1959 Bacon ..... A44B 11/20 D11/216
3,263,292 A * 8/1966 Fekete ..... A41F 1/00 2/325
3,589,052 A * 6/1971 King ..... A01K 95/00 43/44.88
4,128,920 A * 12/1978 Bourguignon ..... A43B 1/0054 24/116 A
4,377,078 A * 3/1983 Block ..... A44C 5/2057 63/3.1
4,630,317 A * 12/1986 Brown ..... A61F 9/045 2/909
4,854,014 A * 8/1989 Ueno ..... F16B 21/088 292/319
5,070,545 A * 12/1991 Tapia ..... A42B 1/0184 2/171.1
5,075,898 A * 12/1991 Bedient ..... A42B 1/0185 2/10
5,105,476 A * 4/1992 Cox ..... A61F 9/045 2/DIG. 11
5,253,369 A * 10/1993 Patterson, Jr. ..... A42B 1/04 2/200.1
5,272,772 A * 12/1993 Hahn ..... A42B 1/22 2/418
5,370,661 A * 12/1994 Branch ..... A61F 2/0811 24/17 AP
5,471,684 A * 12/1995 Casale ..... A42B 1/0184 2/10
5,481,759 A * 1/1996 Rinaldi ..... A42B 1/0181 2/171.1
5,533,211 A * 7/1996 Mehrens ..... A42B 1/0184 2/182.1
5,537,719 A * 7/1996 Freed ..... B65D 63/1081 24/17 AP
5,613,246 A 3/1997 Alexander
5,630,230 A 5/1997 Fujino et al.
5,673,829 A * 10/1997 Hartshorn ..... A45F 5/02 224/256
5,715,534 A * 2/1998 Mobley ..... A42B 1/0184 2/10
5,839,125 A * 11/1998 Chen ..... A42B 1/0185 2/10
5,862,523 A 1/1999 Proctor
5,898,935 A * 5/1999 Davis ..... A42B 1/247 2/13
5,903,925 A * 5/1999 Engebretson ..... A42B 1/004 2/244
5,909,803 A * 6/1999 Clark ..... A42B 1/22 2/195.2
6,202,218 B1 * 3/2001 Chen ..... A42B 1/0185 2/175.1
6,243,877 B1 * 6/2001 Heyward, Jr. ..... A42B 1/0184 2/195.1
6,438,964 B1 * 8/2002 Giblin ..... H10N 10/13 62/3.5
6,457,180 B1 * 10/2002 Jung ..... A42B 1/0184 2/424
6,473,907 B1 * 11/2002 Harwood ..... A42B 1/0184 2/209.13
6,598,236 B1 * 7/2003 Gantt ..... A42B 1/008 2/DIG. 1
6,643,848 B1 * 11/2003 May ..... A42B 1/241 2/209.12
6,728,972 B1 * 5/2004 Whitley ..... A42B 1/02 2/209.12
6,959,454 B2 * 11/2005 DeWinter ..... A42B 1/0182 2/12
9,307,979 B1 * 4/2016 Bennett ..... A61B 17/06166
9,499,317 B2 * 11/2016 Comaniuk ..... F16L 3/137
10,939,716 B1 * 3/2021 Toro ..... A42B 1/0184
2002/0144334 A1 * 10/2002 Brooks ..... A42B 1/206 2/209.12
2003/0150047 A1 * 8/2003 Hyman ..... B44C 5/02 2/209.13
2003/0159707 A1 * 8/2003 Di Luca ..... A45D 19/18 132/270
2004/0040067 A1 * 3/2004 Pong ..... A42B 1/22 2/195.2
2005/0241116 A1 * 11/2005 Stewart ..... B65D 63/1081 24/16 PB
2006/0010567 A1 * 1/2006 Vazquez ..... A42B 1/206 2/175.1
2007/0017003 A1 * 1/2007 Harris ..... A42B 1/0184 2/195.1
2009/0032049 A1 2/2009 Rabin et al.
2010/0252054 A1 * 10/2010 Slatten ..... A61F 5/05891 128/845
2010/0281661 A1 * 11/2010 Harada ..... A44B 11/06 24/593.11
2011/0088141 A1 * 4/2011 Davis ..... A42B 1/0184 2/195.1
2012/0227159 A1 * 9/2012 Kaufman ..... A61F 9/045 2/181
2012/0227160 A1 9/2012 McGoogan
2012/0297521 A1 * 11/2012 Shirai ..... A41F 1/008 24/163 R
2013/0014351 A1 * 1/2013 Kuglen ..... B65D 63/1027 24/17 B
2014/0268683 A1 9/2014 Waters
2015/0189938 A1 * 7/2015 Reinhart ..... A42B 1/0184 2/195.2
2015/0223530 A1 * 8/2015 Grieco ..... A41D 20/00 2/209.3
2015/0296916 A1 * 10/2015 Olivera, II ..... A42B 1/0184 2/181
2017/0245572 A1 * 8/2017 Han ..... A63H 33/086
2017/0325532 A1 * 11/2017 Gerpheide ..... F21S 9/037
2018/0064196 A1 * 3/2018 Thompson-Buist ... A42B 1/041
2018/0282036 A1 * 10/2018 Watson ..... B65D 63/1027
2019/0037950 A1 * 2/2019 Prezioso ..... A42B 1/004
2019/0298007 A1 * 10/2019 Velger ..... A42B 1/225
2019/0357616 A1 * 11/2019 Van Akin ..... A42B 1/0184
2020/0154809 A1 * 5/2020 Gerpheide ..... A42B 1/0184
2021/0045484 A1 * 2/2021 An ..... A42B 1/18
2021/0145102 A1 * 5/2021 Tang ..... A42B 1/0184
2022/0095732 A1 * 3/2022 Newman ..... A44B 11/065
2022/0232922 A1 * 7/2022 Wali ..... A42B 1/0181
2023/0013827 A1 * 1/2023 Baxter ..... A41D 13/00

OTHER PUBLICATIONS

International Search Report of the International Searching Authority in International Application No. PCT/US2020/035117, dated Aug. 26, 2020, 3 pages.

Written Opinion of the International Searching Authority in International Application No. PCT/US2020/035117, dated Aug. 26, 2020, 7 pages.

* cited by examiner

KNIT BRIM AND USES THEREOF

PRIORITY

The present application is a 371 International of PCT Application No. PCT/US2020/035117, filed on May 29, 2020, which claims the benefit of U.S. Provisional Application No. 62/855,023, filed on May 31, 2019, which are incorporated by reference in their entirety herein.

FIELD

The present disclosure relates generally to head wear and particularly, to a brim set to be used in a knit hat.

BACKGROUND

Millions of knit hats are worn in the U.S. market, which have no sun protection or specific style. Accordingly, there is a need to refit the currently-available knit hats in order to impart different functionalities, such as sun-proof, different styles, etc., in a convenient and economic way.

SUMMARY

Disclosed herein is a brim set for a knit hat, the brim set can include an adjustable strap in a circular shape and a brim attachment connectable onto the adjustable strap, wherein the edge of the knit hat can be folded up to form an annular space between an inner fabric and an outer fabric to house the adjustable strap. The brim set can include a plurality of brim attachments, wherein the brim attachments are distributed along the adjustable strap. The number of the brim attachments can be two, three, or four. In some embodiments, the brim attachment can include a light source. The light source is capable of displaying a variety of different colors. In some embodiments, the adjustable strap can include a frame and a fastener. The size of the adjustable strap can be adjusted by cooperating a plurality of pegs on the frame with a plurality of perforations on the fastener. In some embodiments, the size of the adjustable strap can be adjusted by cooperating a bead section and a tube section. In some embodiments, the brim set according to the present disclosure can include a connector to connect the brim attachment onto the adjustable strap. The connector can be a one-way connector or a two-way connector. The two-way connector can be a latch. The latch can include a rod to engage a dock present in a brim attachment and a clip to engage a frame or a fastener of the adjustable strap. In some embodiments, the brim attachment can include a plurality of docks having varying depths. The docks can provide for a distance of about 0.4 to 1.5 cm, about 2.0 to 3.1 cm, or about 3.3 to 3.8 cm between the brim attachment and the adjustable strap. In some embodiments, the adjustable strap can include an inner space. The inner space can be filled with a cooling element or a warming element. In some embodiments, the adjustable strap, the brim attachment, or both the adjustable strap and brim attachment can be made of a plastic material.

Also disclosed herein is a knit hat including a brim set present in an annular space between an inner fabric and an outer fabric of the hat formed by folding up an edge of the knit hat, wherein the brim set can include an adjustable strap in a circular shape, a brim attachment, and a connector to connect the brim attachment onto the adjustable strap. Further disclosed herein is a method of forming a knit hat, the method can include folding up an edge of the knit hat to form an annular space between an inner fabric and an outer fabric, and placing a brim set into the annular space, wherein the brim set can include an adjustable strap in a circular shape, a brim attachment, and a connector to connect the brim attachment onto the strap. Additionally disclosed herein is a brim set for a sweatband or headband, the brim set can include an adjustable strap in a circular shape and a brim attachment connectable onto the adjustable strap, wherein the sweatband or headband can include a double-layer fabric with a slit, thereby enabling the placement of the brim set through the slit inside the sweatband or headband. A brim set can further include a sweatband or headband with a slit configured to allow the insertion of the brim set into the interior of the sweatband or headband.

BRIEF DESCRIPTION OF DRAWINGS

In order to facilitate a full understanding of the present disclosure, reference is now made to the accompanying drawings, in which like elements are referenced with like numerals. These drawings should not be construed as limiting the present disclosure, but are intended to be illustrative only. The drawings are not necessarily to scale, or inclusive of all elements of a system, emphasis instead generally being placed upon illustrating the concepts, structures, and techniques sought to be protected herein.

DESCRIPTION

Figure 1A:
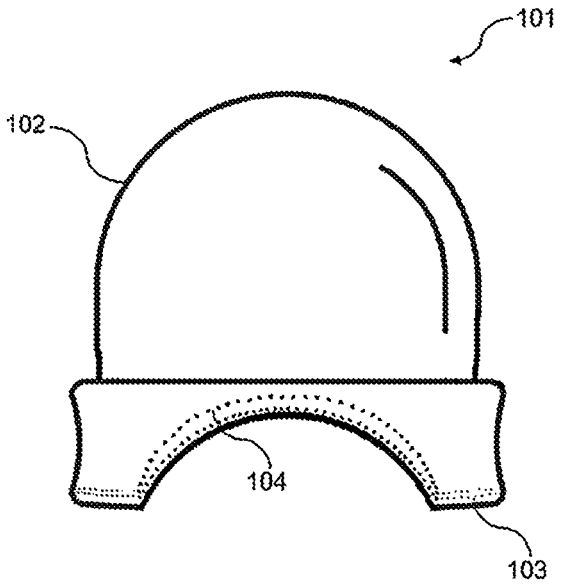
FIG. 1A is a front view of a knit hat with a standard style enabled by the disclosed brim set, according to some embodiments of the present disclosure.

Provided herein are brim sets for knit hats that provide eye protection against the sun. It can also allow its user to create numerous unique fashions and styles. A knit hat is typically made of knit wool, synthetic fibers, or other suitable fibers. In general, a knit hat is a parallel sided tube, with a closed end. The opening of the tube surrounds the wearer's head. A knit hat can have a simple, tapering constructions, though many variants exist. A knit hat can be tapered at the top. The stretch of the knitting itself hugs the head, keeping the cap secure. They can be topped with a pom-pom or loose tassels. Knit hats can have a folded brim, or none, and can be worn tightly fitting the head or loose on top.

A brim set can comprise an adjustable strap, a connector, and a brim attachment. The connector can possess a one-way connecting means or two-way connecting means. In some embodiments, the connector can be a two-way connector composed of a clip and a rod. The clip enables the latch to snap onto the adjustable strap, the rod enables the latch to connect to the brim attachment by inserting the rod into a dock on the brim attachment. In this way, the latch can effectively connect the brim attachment and the adjustable strap. A brim attachment can have a plurality of docks on one side, the docks can have different depths, such that when the latch is inserted into the dock, the rod portion of the latch exposed outside can have different lengths, resulting in different ranges between the brim attachment and the adjustable strap after they are assembled. In some embodiments, the connector can have a one-way connecting means, in which one side of the connector (e.g., one part of a snap, hook and loop fasteners (e.g., VELCRO®), button/button hole, buckle, hook and eye, clip, clamp, magnet, zipper, and dock/rod) can be affixed to a brim attachment. The other side of the one-way connector (e.g., one part of a snap, hook and loop fasteners (e.g., VELCRO®), button/button hole, buckle, hook and eye, clip, clamp, magnet, zipper, and dock/rod) can be connected to an adjustable strap.

An adjustable strap can be a closed circle/ring, which provides a foundation to support the brim attachment affixed thereon via the latch. An adjustable strap is composed of a frame and a fastener. In some embodiments, the fastener can keep the adjustable strap from moving around or sliding out of the knit hat, which can serve as an anchor for the adjustable strap. In some embodiments, the two terminal portions of the frame can have a plurality of pegs, constituting adjustable portion on the adjustable strap. The fastener can have a plurality of perforations, which can cooperate with the plurality of pegs on the adjustable strap by pushing the pegs into the perforations, this effectively assembles the frame and the fastener together to constitute the adjustable strap. In some embodiments, other connectors between the frame and the fastener can be used, including, but not limited to buttons, zippers, snaps, hook and loop fasteners (e.g., VELCRO®), buckles, hooks, magnets, clips, and clamps.

To install the brim set into a knit hat, the edge/bottom part of the knit hat is folded up to provide an annular space. The adjustable strap is placed inside the annular space. The brim attachment can be assembled with the latch, by inserting the rod portion of the latch into a dock on the brim attachment. The assembled brim attachment/latch is then snapped onto the adjustable strap (via clip portion of the latch) placed inside the annular space. This effectively finishes the assembly of the brim set. The entire brim set is then wrapped inside the annular space of the knit hat.

An adjustable strap for a brim set makes it possible for users to interchange and mix and match multiple brim attachments, making the eye protection fully customizable and fashionable. In some embodiments, one brim attachment can be affixed onto a frame or a fastener portion of an adjustable strap. In some embodiments, a plurality of brim attachments can be affixed onto the frame or fastener portion of the adjustable strap.

A brim set can include an adjustable strap that can fit inside of a knit hat. The adjustable strap can include a fastener connecting two terminal ends of a frame. A brim set can comprise variable sized brim attachments. The brim attachments can be removable. In an example brim attachments can be removably fastened along any area of the frame or fastener portion of the adjustable strap using any suitable fastener (e.g. snaps, latches, zippers, etc.). Brim attachments can be reversible, positionable and extendable, allowing a user the freedom to create different new styles and fashions. The connection between brim attachments and a frame or fastener portion of an adjustable strap can be reversible by using a connector to connect between the brim attachments and the adjustable strap, which enables a person to install different styles of brim attachments at different times and occasions. In some embodiments, the connection mechanism can allow the brim attachments to freely move at a height dimension and move to different positions on the frame or fastener portion of the adjustable strap. In some embodiments, there can be different docks on the brim attachments such that the distance between the brim attachments and the adjustable strap can be extendable. In some embodiments, brim attachments offer instant sun protection, combined with a specific fashion and style that is customizable to suit the user.

In some embodiments, a brim set can be used in headwear including, but not limited to, knit hats, sports sweatbands, head scarfs, and winter ski headbands. In some embodiments, a brim set is used for a knit hat.

In some embodiments, a brim set comprises a chilling portion. For example, an adjustable strap can be a chill strap. A chill strap can comprise an adjustable strap with an inner space filled with cooling elements, which can be worn to cool the user. The inner space can be in the frame or the fastener. In some embodiments, the inner space is in the frame. In some embodiments, a chill strap can be kept inside a freezer before using, which can provide a cooling effect during wearing. Such a cooling effect can be achieved by filling the chill strap with cooling agents, including, but not limited to, ammonium nitrate, urea, hydroxyethyl cellulose, sodium polyacrylate, ammonium chloride, silica gel, and diethylene glycol. The chill strap can fit inside of sports sweatbands, knit hats, or head scarfs, for example. In some embodiments, a chill strap including the chilling portion can be placed inside a sweatband or a headband. In some embodiments, a sun protecting brim attachment can be added to the sweatband and keep wearer's head chilled at the same time.

A brim set can comprise a warming element. The warming element can be placed inside an inner space in the frame or fastener portion of the adjustable strap. In some embodiments, the inner space housing the warming element is in the frame. Warming elements can be, for example, air-activated warmers. An air-activated warmer can comprise, for example, cellulose, iron, activated carbon, vermiculite (or other composition to hold water) and salt and produce heat from the exothermic oxidation of iron when exposed to air. A warming element can be a super saturated, crystallization-type warmer. This type of warmer can be recharged by immersing the warmer in very hot water until the contents are uniform and then allowing it to cool. The release of heat is triggered by flexing a small metal disk in the warmer, which generates nucleation centers that initiate crystallization. Heat is required to dissolve salt in its own water of crystallization and it is this heat that is released when crystallization is initiated. Battery operated warmers can also be used. These warmers use electrically resistive heating devices to convert electrical energy in the battery. Rechargeable electronic warmers can be charged from a power supply, with many recharge cycles possible.

Figure 1B:
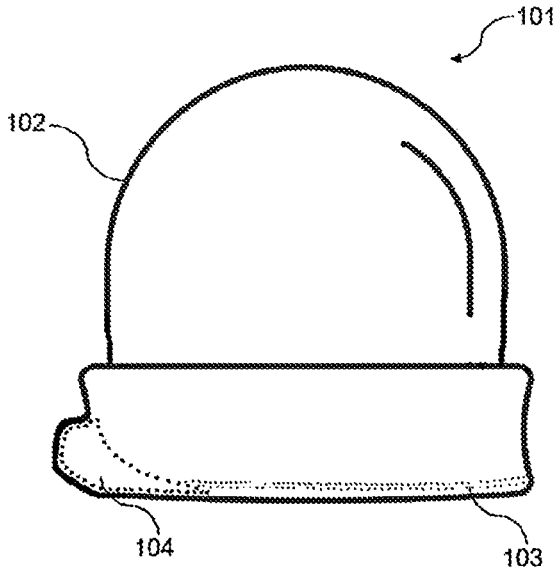
FIG. 1B is a side view of a knit hat with a standard style enabled by the disclosed brim set, according to some embodiments of the present disclosure.
Figure 1C:
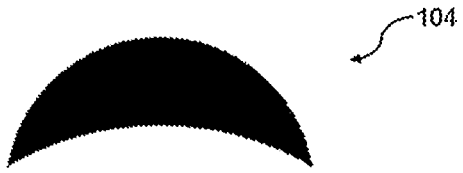
FIG. 1C is a brim attachment for a standard style of a brim set, according to some embodiments of the present disclosure.

FIG. 1A is a front view of a knit hat 101 with a standard style, according to some embodiments of the present disclosure. The standard style of a knit hat 102 can be used with a brim set. A standard brim attachment 104 can be connected to a fastener portion of an adjustable strap 103 placed inside knit hat 102. FIG. 1B is a side view of knit hat 101 with a standard style. This side view can provide a better insight to the position of brim attachment 104 connected to a fastener portion of an adjustable strap 103. In some embodiments, a brim attachment 104 can be directly located on top of a wearer's forehead. In some embodiments, a brim attachment 104 can be positioned on the side of a wearer's head close to the ear. In some embodiments, a brim attachment 104 can be positioned on the back side of a wearer's head. FIG. 1C provides a specific view of brim attachment 104 with a standard styling.

Figure 2A:
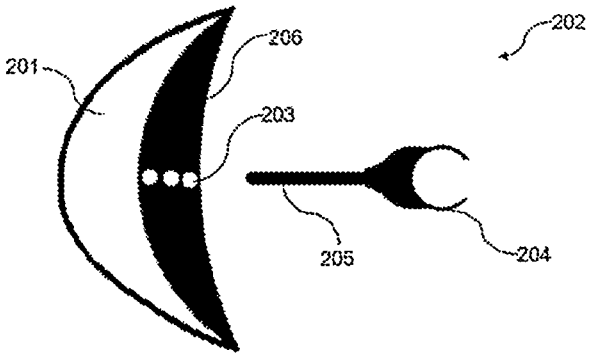
FIG. 2A shows a brim attachment and a latch for a brim set, according to some embodiments of the present disclosure.

FIG. 2A shows a brim attachment 201 and a connector, in this case a two-way connector such as a latch 202, for a brim set, according to some embodiments of the present disclosure. Latch 202 can include a clip 204 and a rod 205. Rod 205 can be inserted into a dock 203 to be connected to brim attachment 201. Clip 204 can be used to snap onto an adjustable strap, enabling the connection between brim attachment 201 and the frame or the fastener portion of the adjustable strap. In some embodiments, clip 204 is snapped onto the frame of the adjustable strap. In some embodiments, a variety of different docks 203 can be used, enabling different modes of assembly between brim attachment 201 and latch 202, depending on the distance between them at the assembled stage. A non-limiting number of docks that can be present in a brim attachment 201, for example, one, two, three, four, and five. FIG. 2A is a top view of a brim attachment, for purposes of illustration, a shadowed region 206 is depicted as a side of the brim attachment, in which docks 203 can be positioned and aligned vertically. In some embodiments, docks 203 can be holes corresponding to the diameters of rod 205, enabling connections between the brim attachment and the latch. In some embodiments, the docks can be made with different depths such that the distance between the brim attachment and the latch can be adjusted. In some embodiments, three docks can be present in a brim attachment, as illustrated in FIG. 2A, which can allow connection between brim attachment 201 and a fastener of an adjustable strap in different distances. This is further shown in FIGS. 2B-2D below, where when the rod 205 is inserted into different docks 203, the effective length of the rod 205 is changed thereby changing the distance between the adjustable strap 103 and the brim attachment 201.

Figure 2B:
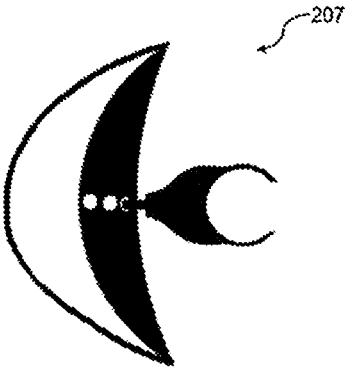
FIG. 2B illustrates close range assembly of a brim attachment and a latch, according to some embodiments of the present disclosure.

FIG. 2B illustrates close range assembly 207 of a brim attachment and a latch, according to some embodiments of the present disclosure. In some embodiments, the length of a close range assembly, measured by the distance between dock 203 and clip 204, corresponding to the exposed rod portion, can be about 0.4 to 1.5 cm, about 0.5 to 1.3 cm, about 0.6 to 1.0 cm, about 0.4 to 1.0 cm, or about 0.6 to 1.5 cm. In some embodiments, the close range assembly can provide about 0.64 cm distance between dock 203 and clip 204.

Figure 2C:
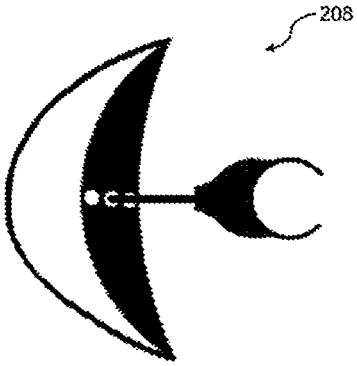
FIG. 2C illustrates medium range assembly of a brim attachment and a latch, according to some embodiments of the present disclosure.

FIG. 2C illustrates medium range assembly 208 of a brim attachment and a latch, according to some embodiments of the present disclosure. In some embodiments, the length of a close range assembly, measured by the distance between dock 203 and clip 204, corresponding to the exposed rod portion, can be about 2.0 to 3.1 cm, about 2.1 to 3.0 cm, about 2.2 to 2.9 cm, about 2.3 to 2.8 cm, about 2.0 to 2.8 cm, or about 2.3 to 3.1 cm. In some embodiments, the medium range assembly can provide about 2.54 cm distance between dock 203 and clip 204.

Figure 2D:
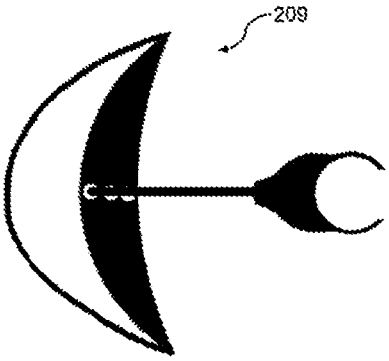
FIG. 2D illustrates extended range assembly of a brim attachment and a latch, according to some embodiments of the present disclosure.

FIG. 2D illustrates extended range assembly 209 of a brim attachment and a latch, according to some embodiments of the present disclosure. In some embodiments, the length of a close range assembly, measured by the distance between dock 203 and clip 204, corresponding to the exposed rod portion, can be about 3.3 to 3.8 cm, about 3.4 to 3.7 cm, about 3.5 to 3.6 cm, about 3.3 to 3.6 cm, or about 3.5 to 3.8 cm. In some embodiments, the extended range assembly can provide about 3.8 cm distance between dock 203 and clip 204.

In some embodiments, a one-way connector (not depicted in the figure) can be used. A first side or end of a one-way connector can be present on the brim attachment, and a second side or end of the one-way connector can be present on the adjustable strap, either on the frame or the fastener portion. One way connectors include, but are not limited to, buttons, zippers, snaps, hook and loop fasteners (e.g., VELCRO®), buckles, hooks, clips, magnets, and clamps. In some embodiments, the adjustable strap can include a frame and a fastener, which is shown in FIGS. 3A-3C and discussed below.

Figure 3A:
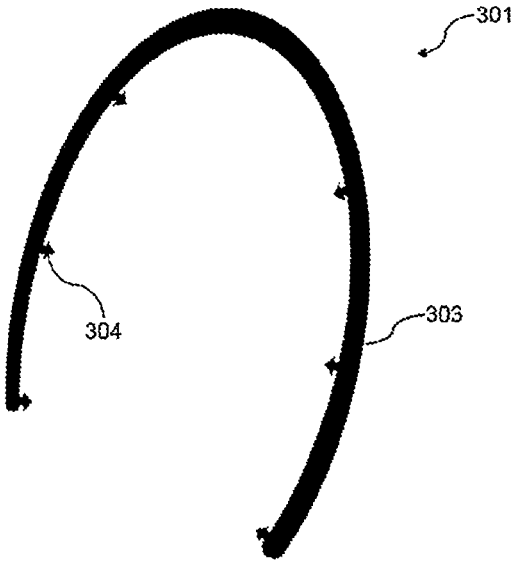
FIG. 3A illustrates an adjustable strap of a brim set, according to some embodiments of the present disclosure.
Figure 3B:
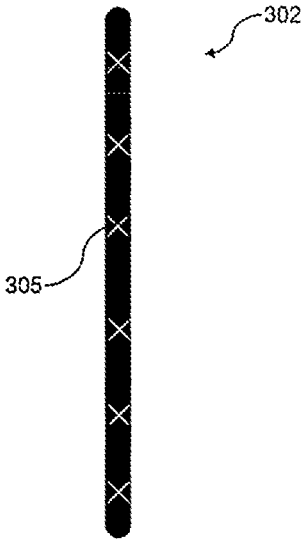
FIG. 3B illustrates a fastener for an adjustable strap, according to some embodiments of the present disclosure.

In some embodiments, an adjustable strap can include a frame 301 in a substantially arced shape, as illustrated by FIG. 3A, and a fastener portion 302, as illustrated by FIG. 3B. The two terminal portions of frame 301, designated as interconnection terminals 303 can include a quantity of pegs 304 (shown) or buckles (not shown) for purposes of connection with a fastener portion 302. In some embodiments, the number of pegs 304 can be about five to ten. In some embodiments, the number of pegs 304 can be about six. In some embodiments, frame 301 can include an inner space, which can be filled with warming or cooling element to enable a warming function in winter time or a cooling function in summer time.

FIG. 3B illustrates a fastener portion 302 of a brim set, according to some embodiments of the present disclosure. In some embodiments, fastener portion 302 can be made of plastic material or any other suitable material. As a non-limiting embodiment, fastener portion 302 can include a quantity of perforations 305 to cooperate with the quantity of pegs 304 spread along interconnection terminals 303 of frame 301, by inserting the pegs into the perforations for purposes of fastening. After frame 301 and fastener portion 302 are assembled to into the adjustable strap, it can be in a substantially circular shape. The distance between each peg 304 can be about 0.2 to 2 cm, about 0.3 to 1.8 cm, about 0.4 to 1.6 cm, about 0.5 to 1.4 cm, about 0.6 to 1.2 cm, about 0.7 to 1.0 cm, about 0.2 to 1.0 cm, or about 0.7 to 2 cm. The distance between each perforation 305 can be the same. In this way, pegs 304 and perforations 305 can be cooperated in a staggered manner. An adjustable portion of the adjustable strap is thus formed between interconnection terminal 303 of frame 301 and fastener portion 302, relying on the cooperation between pegs 304 and perforations 305, enabling a person to adjust the brim set based on the size of one's head.

In some embodiments, instead of relying on pegs and perforations, other non-limiting connectors can be used for purposes of adjusting the size of the adjustable strap can be used (e.g., hook and loop fasteners (e.g., VELCRO®), zippers, magnets, clamps, buckles, hooks, snaps, and buttons.

In some embodiments, one of the two terminals of the frame can include a plurality of pegs, the other terminal of the frame can include a plurality of perforations, such that a separate fastener is not needed for purposes of adjusting the size of the strap. In some embodiments, instead of relying on cooperation between pegs and perforations, other types of connectors can be used, including, but not limited to, zippers, magnets, buttons, hook and loop fasteners (e.g., VELCRO®) straps, and other ways of binding the edges of an opening commonly known for one of ordinary skill in the art.

In some embodiments, a brim set includes an adjustable strap, a connector, and a brim attachment that are be made of plastic materials, metal, wood, or other suitable material. Plastic materials can include, but are not limited to, polyethylene, polypropylene, polystyrene, polyvinyl chloride, nylon, polyacrylate, poly(methyl methacrylate), and rubber. Metal materials can include, but are not limited to, iron, aluminum, titanium, steel, copper, brass, bronze, zinc, tungsten, nickel, cobalt, tin, lead, silicon, and alloys thereof.

Figure 4A:
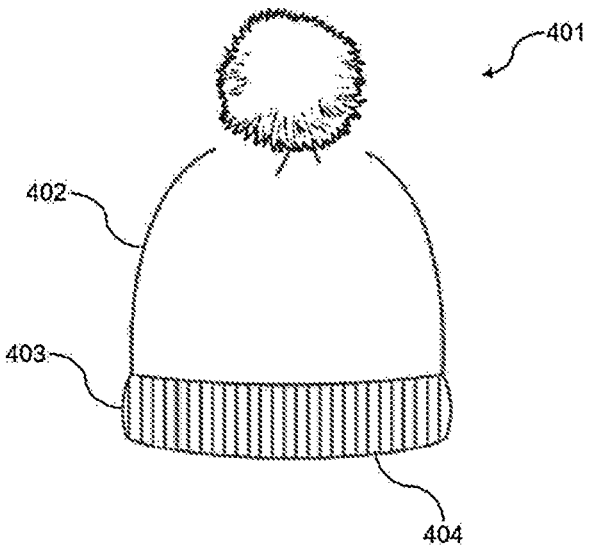
FIG. 4A shows a knit hat.

FIGS. 4A-4D illustrate a brim set that enables a specific styling of a knit hat. FIG. 4A shows a conventional knit hat 401. In some embodiments, a knit hat 401 can be folded up along the edge to form an annular space between inner fabric 402 and outer fabric 403. The intersection between inner fabric 402 and outer fabric 403 can form a crease 404. The adjustable strap of a brim set can be placed into the annular space directly inside the crease 404. This can immobilize the adjustable strap in this particular position in the knit hat, such that it can further provide a anchoring point when the brim attachment is affixed thereon. In some embodiments, depending on the size of the knit hat used for the present disclosure, the bottom one sixth portion of the knit hat can be folded up to form outer fabric 403 for purposes of placing the adjustable strap. In some embodiments, the bottom one fifth, one fourth, or one third portion of the knit hat can be folded up.

Figure 4B:
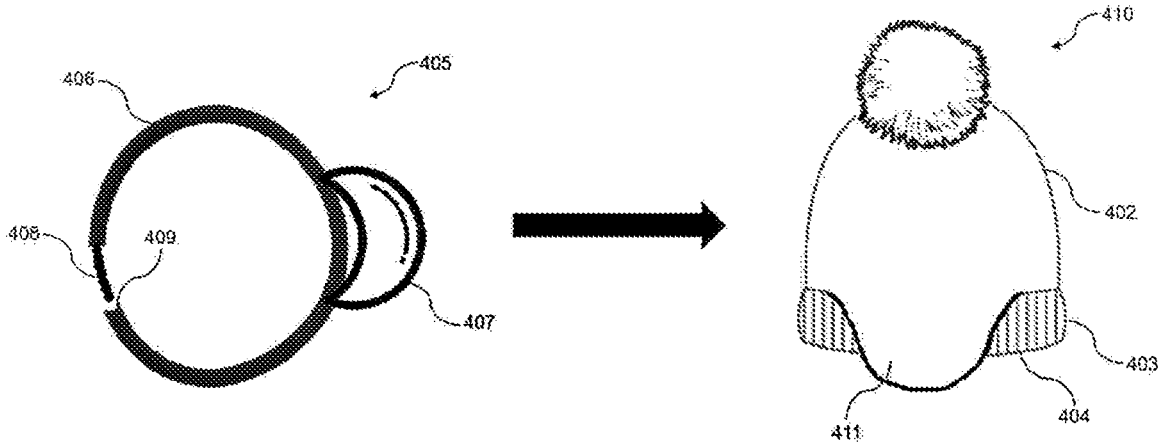
FIG. 4B illustrates how a brim set is placed into a knit hat, according to some embodiments of the present disclosure.
Figure 4C:
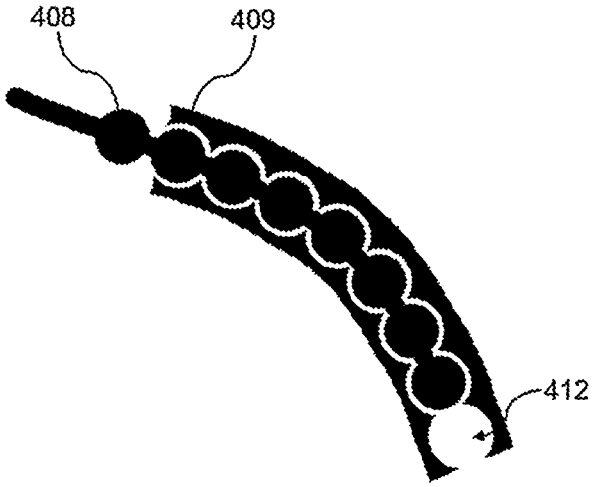
FIG. 4C illustrates an expanded view of a bead/tube region for an adjustable strap, according to some embodiments of the present disclosure.

FIG. 4B shows how a brim set 405 according to some embodiments of the present disclosure can be inserted into knit hat 401, using a different locking mechanism to adjust the size of the adjustable strap compared to FIG. 3. A brim set 405 can include an adjustable strap with a brim attachment 407 affixed thereon. The adjustable strap can include a frame 406 and a fastener comprising a bead section 408 and a tube section 409. The size of the adjustable strap can be adjusted by cooperating bead section 408 and tube section 409. Bead section 408 can have a plurality of beads, the diameter of which can be about the same or slightly smaller compared to the diameter of the bead section 408, enabling locking between them. In some embodiments, the diameter of bead section 408 can be about 0.1 to 1.0 cm, about 0.2 to 0.9 cm, about 0.3 to 0.8 cm, about 0.4 to 0.7 cm, about 0.5 to 0.6 cm, about 0.1 to 0.6 cm, or about 0.5 to 1.0 cm. In some embodiments, the diameter of bead section 408 can be about 0.5 cm, the internal dimeter of corresponding tube section 409 can be about 0.05 cm smaller (about 0.45 cm) to enablement adjustment of the size while being able to lock at a specific size. FIG. 4C illustrates an expanded view of a bead/tube region for adjustable strap, according to some embodiments of the present disclosure. A plurality of beads in bead section 408 can be pushed into a plurality of acceptors 412 in tube section 409. Depending on the size of a wearer's head, the wearer can determine how many beads should be inserted into tube section 409, thereby adjusting the size of adjustable strap.

A front view of a brim set-enabled knit hat 410 is illustrated in FIG. 4B. Adjustable strap is placed inside the annular space formed between inner fabric 402 and outer fabric 403, and directly adjacent to crease 404. Brim attachment 407, after affixed onto adjustable strap, can protrude part of outer fabric 403 to form a visor 411, which can be used to display different stylings based on a common knit hat.

Figure 4D:
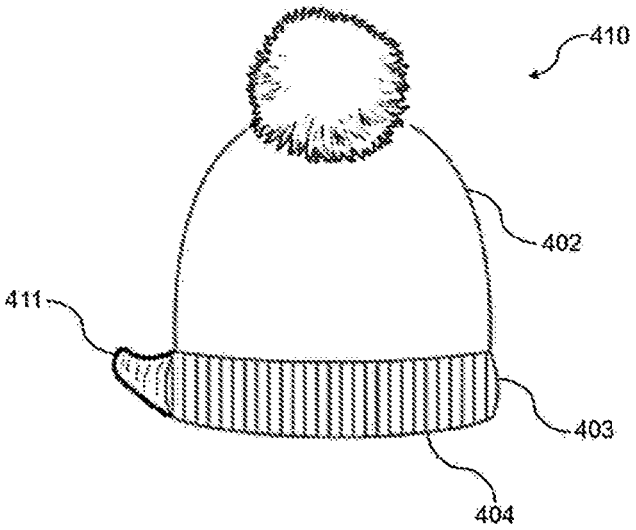
FIG. 4D illustrates a knit hat with a style enabled by a brim set, according to some embodiments of the present disclosure.

FIG. 4D illustrates a side view of brim set-enabled knit hat 410, which provides another view of visor 411, formed by protruding part of outer fabric 403 by the brim set placed inside the annular space formed by outer fabric 403 and inner fabric 402.

Figure 5A:
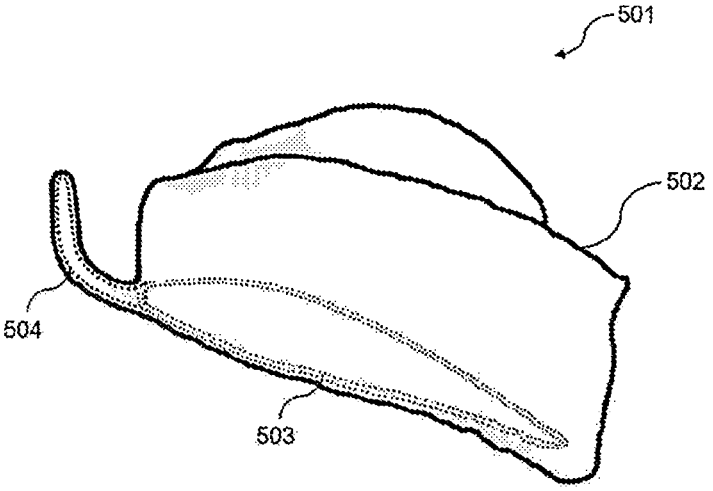
FIG. 5A illustrates duck styling of a knit hat enabled by the disclosed brim set, according to some embodiments of the present disclosure.
Figure 5B:
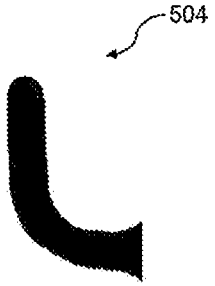
FIG. 5B is a brim attachment for a duck styling of a brim set, according to some embodiments of the present disclosure.

FIG. 5A illustrates duck styling of a knit hat 501. The duck styling of a knit hat 502 can be enabled by a duck style brim attachment 504 connected to an adjustable strap 503 placed inside knit hat 502. In some embodiments, brim attachment 504 can be directly located on top of a wearer's forehead. In some embodiments, brim attachment 504 can be positioned on the side of a wearer' head close to the ear. In some embodiments, a brim attachment 504 can be positioned on the back side of a wearer's head. FIG. 5B provides a specific view of brim attachment 504 with the duck styling.

Figure 6A:
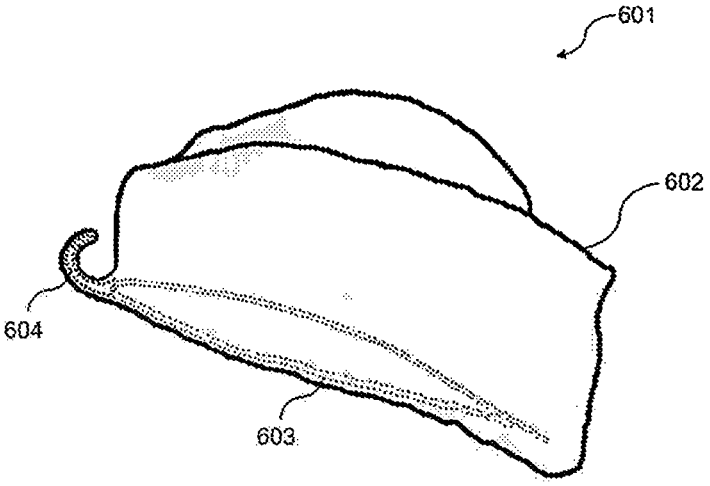
FIG. 6A illustrates duckling style of a knit hat enabled by the disclosed brim set, according to some embodiments of the present disclosure.
Figure 6B:
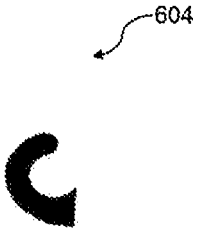
FIG. 6B is a brim attachment for a duckling style of a brim set, according to some embodiments of the present disclosure.

FIG. 6A illustrates ducking style of a knit hat 601. The ducking style of a knit hat 602 can be enabled by a duckling style brim attachment 604 connected to an adjustable strap 603 placed inside knit hat 602. In some embodiments, brim attachment 604 can be directly located on top of a wearer's forehead. In some embodiments, brim attachment 604 can be positioned on the side of a wearer' head close to the ear. In some embodiments, brim attachment 604 can be positioned on the back side of a wearer's head. FIG. 6B provides a specific view of brim attachment 604 with the duckling style.

Figure 7A:
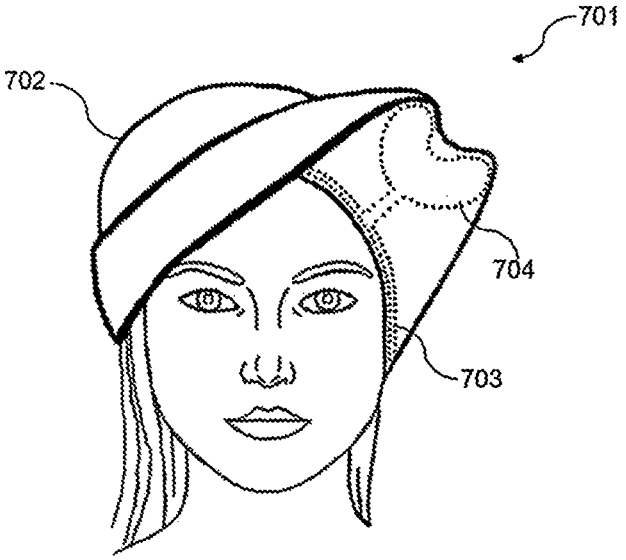
FIG. 7A is a front view of a knit hat with a double-bun style enabled by the disclosed brim set, according to some embodiments of the present disclosure.
Figure 7B:
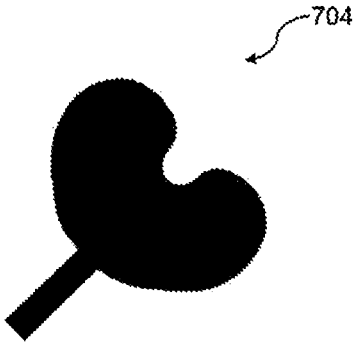
FIG. 7B is a brim attachment for a double-bun style of a brim set, according to some embodiments of the present disclosure.

FIG. 7A is a front view of a knit hat 701 with a double-bun style. The double-bun style of a knit hat 702 can be enabled by a brim attachment 704 substantially mimicking the shape of a double-bun, which can be connected to an adjustable strap 703. In some embodiments, when a person wears knit hat 701, double-bun shaped brim attachment 704 can be on one side of the head. FIG. 7B provides a specific view of brim attachment 704 with the shape of a double-bun.

Figure 8A:
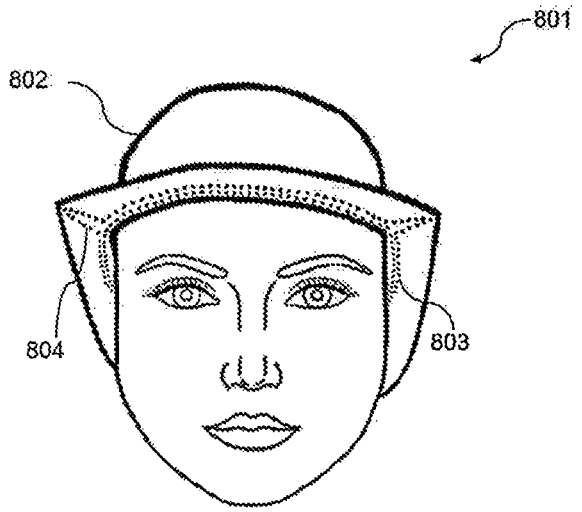
FIG. 8A is a front view of a knit hat with Oslo style enabled by the disclosed brim set, according to some embodiments of the present disclosure.
Figure 8B:
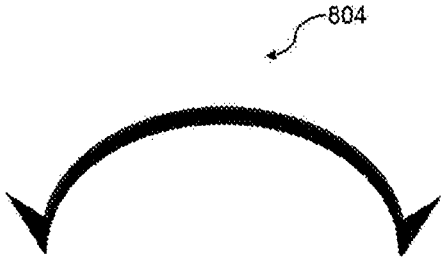
FIG. 8B is a brim attachment for an Oslo style of a brim set, according to some embodiments of the present disclosure.

FIG. 8A is a front view of a knit hat 801 with an Oslo style. The Oslo style of a knit hat 802 can be enabled by a brim attachment 804 with an Oslo style, which can be connected to an adjustable strap 803. In some embodiments, when a person wears knit hat 801, Oslo styled brim attachment 804 can be placed on top of the forehead. FIG. 8B provides a specific view of brim attachment 804 with an Oslo style.

Figure 9A:
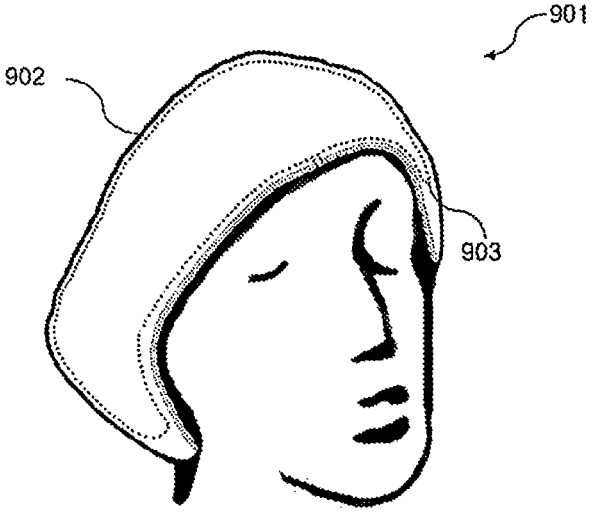
FIG. 9A is a front view of a knit hat with mushroom style enabled by the disclosed brim set, according to some embodiments of the present disclosure.
Figure 9B:
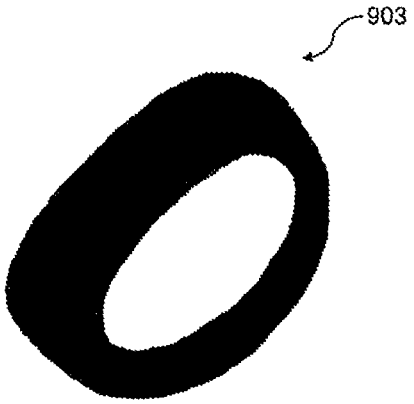
FIG. 9B is a brim attachment for a mushroom style of a brim set, according to some embodiments of the present disclosure.

FIG. 9A is a front view of a knit hat 901 with a mushroom style. The mushroom style of a knit hat 902 can be enabled by a brim attachment 903 with a mushroom style, which can be connected to an adjustable strap. FIG. 9B provides a specific view of brim attachment 904 with a mushroom style.

Figure 10A:
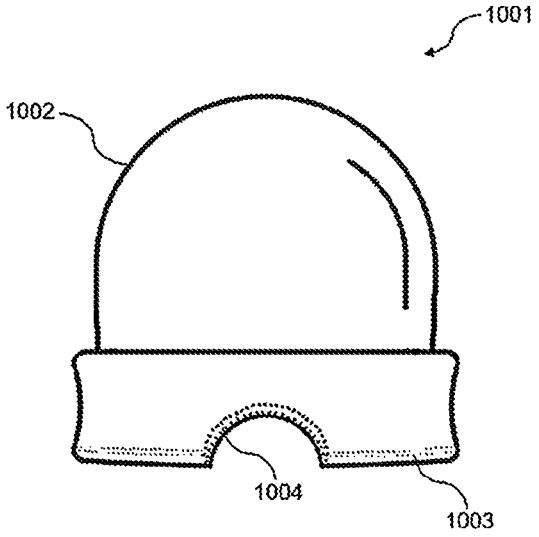
FIG. 10A is a front view of a knit hat with nub style enabled by the disclosed brim set, according to some embodiments of the present disclosure.
Figure 10B:
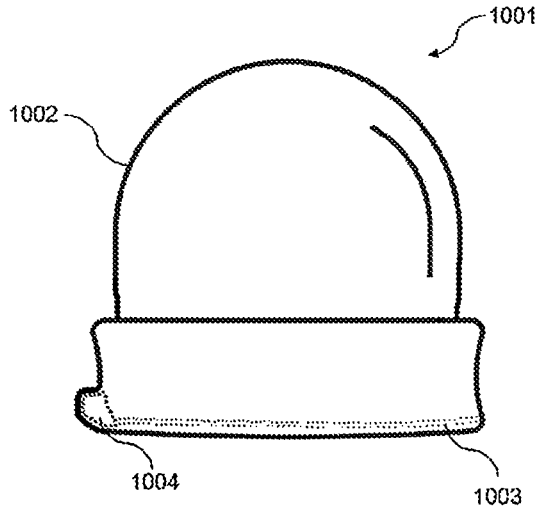
FIG. 10B is a side view of a knit hat with nub style enabled by the disclosed brim set, according to some embodiments of the present disclosure.
Figure 10C:
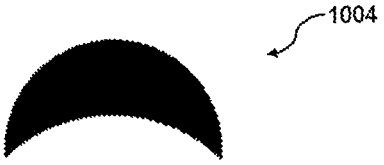
FIG. 10C is a brim attachment for a nub style of a brim set, according to some embodiments of the present disclosure.

FIG. 10A is a front view of a knit hat 1001 with a nub styling, according to some embodiments of the present disclosure. The nub styling of a knit hat 1002 can be enabled by the disclosed brim set. A nub-styled brim attachment 1004 can be connected to an adjustable strap 1003 placed inside knit hat 1002. FIG. 10B is a side view of knit hat 1001 with a nub styling. This side view can provide a better insight to the position of brim attachment 1004 connected to adjustable strap 1003. In some embodiments, brim attachment 1004 can be directly located on top of a wearer's forehead. In some embodiments, brim attachment 1004 can be positioned on the side of a wearer' head close to the ear. In some embodiments, brim attachment 1004 can be positioned on the back side of a wearer's head. FIG. 10C provides a specific view of brim attachment 1004 with the nub styling.

Figure 11A:
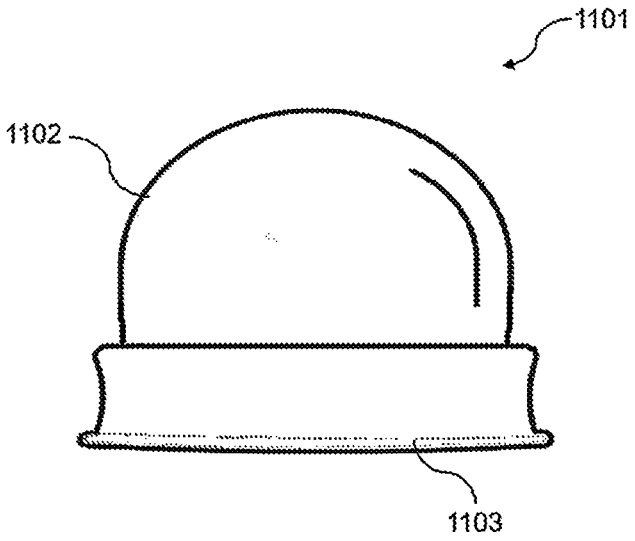
FIG. 11A is a front view of a knit hat with thin styling enabled by the disclosed brim set, according to some embodiments of the present disclosure.
Figure 11B:
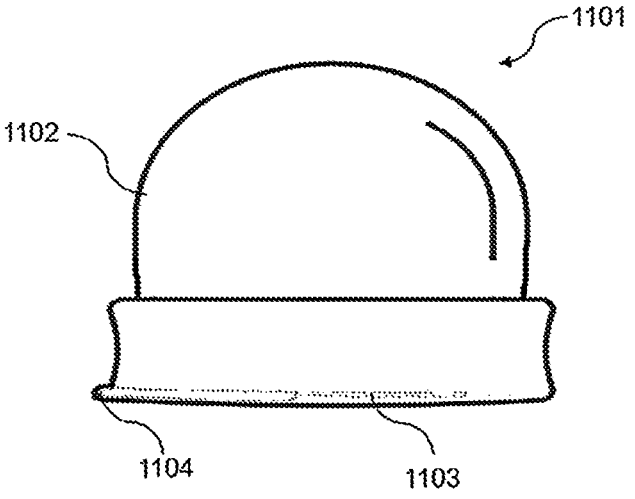
FIG. 11B is a side view of a knit hat with thin styling enabled by the disclosed brim set, according to some embodiments of the present disclosure.
Figure 11C:
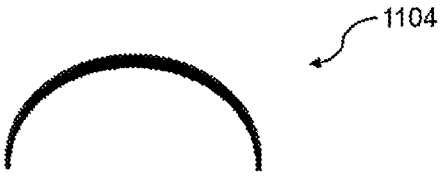
FIG. 11C is a brim attachment for a thin styling of a brim set, according to some embodiments of the present disclosure.

FIG. 11A is a front view of a knit hat 1101 with a thin styling. A thin styling of a knit hat 1102 can be enabled by a thin brim attachment, including a brim attachment in thin style, a connector, and an adjustable strap. A thin-styled brim set 1104 can be connected to an adjustable strap 1103 placed inside knit hat 1102. FIG. 11B is a side view of knit hat 1101 with a thin styling. This side view can provide a better insight to the position of brim attachment 1104 connected to adjustable strap 1103. In some embodiments, brim attachment 1104 can be directly located on top of a wearer's forehead. In some embodiments, brim attachment 1104 can be positioned on the side of a wearer' head close to the ear. In some embodiments, brim attachment 1104 can be positioned on the back side of a wearer's head. FIG. 11C provides a specific view of brim attachment 1104 with the thin styling.

In some embodiments, for example, the standard brim attachment illustrated in FIG. 1, the nub brim attachment illustrated in FIG. 10, and the thin brim attachment illustrated in FIG. 11 are flat without any three-dimensional aspect. In this case the brim attachments will have a thickness of about 0.5 to 1.0 cm. In some embodiments this thickness allows for the use of docks for purposes of accepting a rod portion of a latch. In some embodiments, the standard brim attachment resembles a brim of a standard baseball hat. The standard brim attachment has a regular baseball hat sized brim. That is, a brim that extends out from the hat in an arc shape about 2 to about 4 inches. In some embodiments, a brim attachment in thin style just gives its user the hint of having a brim. For example, That is, a brim that extends out from the hat in an arc shape about 0.25 to about 2 inches. The visor portion of a brim attachment in thin style may not be effective for sun protection but rather for style. The brim in a thin style can be in the shape of a "new moon." In some embodiments, the brim attachment in a nub style can have the smallest size in these different brim styles. In some embodiments, it can have a nub shape mimicking the tip of a cigar. The brim attachment in nub style can be designed for wearers who want the look of subtlety. In some embodiments, the nub brim attachment can be the shape of a waning crescent moon, which can be about 6.0, 6.5, 7.0, 7.5, 7.6, 8.0, 8.5, 9.0 cm or more in length and about 2.0, 2.5, 3.0, 3.5, 3.8, 4.0, 4.5, 5.0 cm or more in width.

Figure 12A:
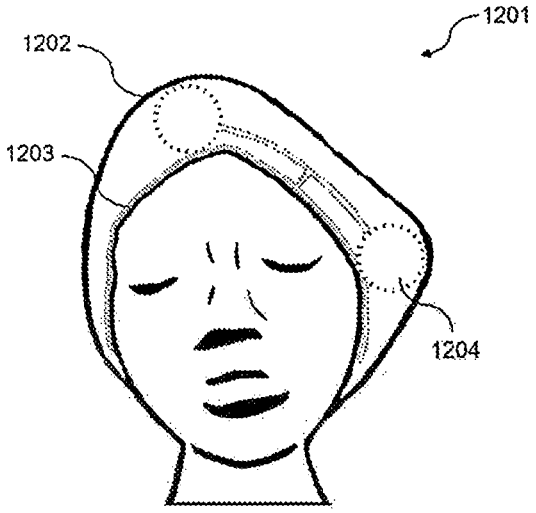
FIG. 12A is a front view of a knit hat with French lady style enabled by the disclosed brim set, according to some embodiments of the present disclosure.
Figure 12B:
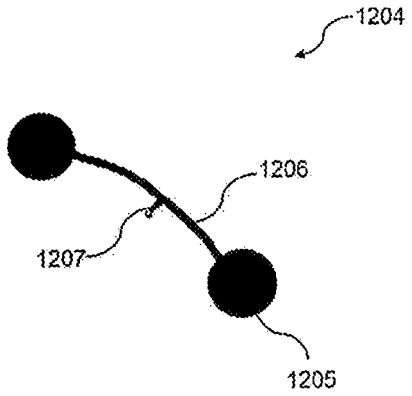
FIG. 12B is a brim attachment for a knit hat with French lady style enabled by the disclosed brim set, according to some embodiments of the present disclosure.

FIG. 12A is a front view of a knit hat 1201 with a French lady style. A French lady style of a knit hat 1202 can be created by a French lady style brim attachment 1204, which can be connected to an adjustable strap 1203. In some embodiments, when a person wears knit hat 1201, a French lady shaped brim attachment 1204 can be on one side of the head. FIG. 12B provides a specific view of brim attachment 1204 with the French lady style, which comprises two round-shape three-dimensional balls 1205 connected by a lever 1206, enabling the appearance of French lady style when placed inside an annular space of a knit hat by folding up the edge. Lever 1206 can be in a relatively curved shape adapting the curve of the wearer's head. Docks can be made in the middle part of lever 1206 for purposes of connecting to a connector such as a latch 1207 illustrated in this embodiment. Latch 1207 can be snapped onto an adjustable strap via the clip on the other side of the latch, this effectively anchors the French lady style brim attachments onto the adjustable strap inside the knit hat.

Figure 13A:
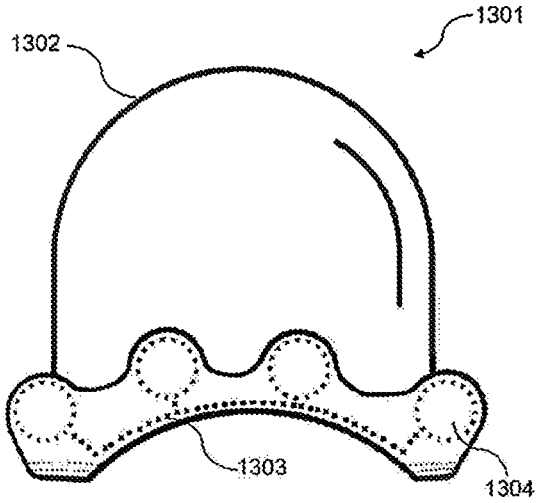
FIG. 13A is a front view of a knit hat with cornet style enabled by the disclosed brim set, according to some embodiments of the present disclosure.
Figure 13B:
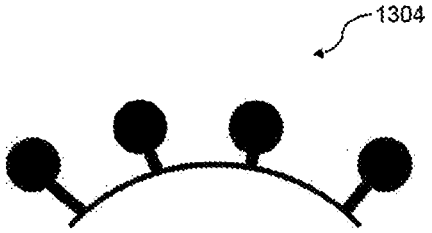
FIG. 13B is a brim attachment for a cornet style of a brim set, according to some embodiments of the present disclosure.

FIG. 13A is a front view of a knit hat 1301 with a cornet style. The cornet style of a knit hat 1302 can be created by a cornet style brim attachment 1304, which can be connected to an adjustable strap 1303. In some embodiments, when a person wears knit hat 1301, cornet shaped brim attachment 1304 can be placed directly on top of the forehead. FIG. 13B provides a specific view of brim attachment 1304 with the cornet style, which comprises an arc-shape supporting frame with four round-shape three-dimensional balls each connected to the supporting frame with a stem. Other non-limiting numbers of the round-shape balls placed on the arc-shape supporting frame can include two, three, five, or six.

Figure 14A:
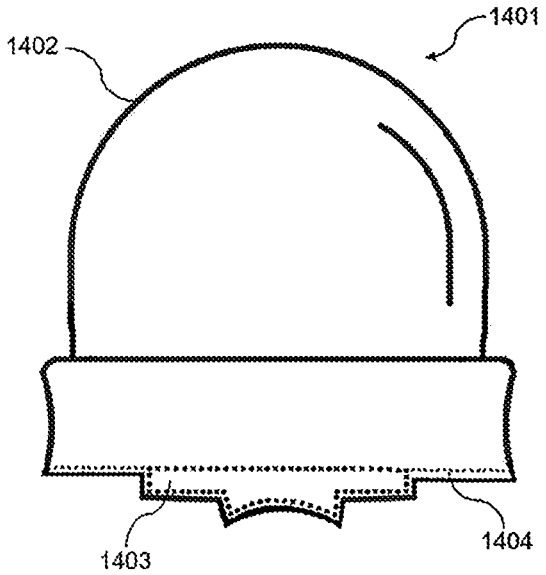
FIG. 14A is a front view of a knit hat with trooper style enabled by the disclosed brim set, according to some embodiments of the present disclosure.
Figure 14B:
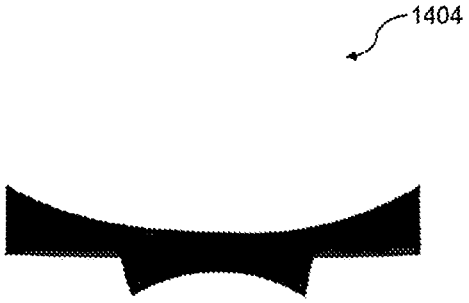
FIG. 14B is a brim attachment for a trooper style of a brim set, according to some embodiments of the present disclosure.

FIG. 14A is a front view of a knit hat 1401 with a trooper style. The trooper style of a knit hat 1402 can be created by a trooper brim attachment 1404, which can be connected to an adjustable strap 1403 and placed into an annular space formed by folding up the edge of the knit hat. In some embodiments, when a person wears a knit hat 1401, a trooper shaped brim attachment 1404 can be position directly on top of the forehead. FIG. 14B provides a specific view of brim attachment 1404 with the trooper style. In some embodiments, the trooper brim is a retro styled visor that can have two differently sized squares. This theme is based on the character Stormtrooper from the Star Wars movie franchise. The trooper brim attachment can be a medium styled rectangular visor with a miniature rectangular extension in the middle, providing extra sun protection.

Figure 15A:
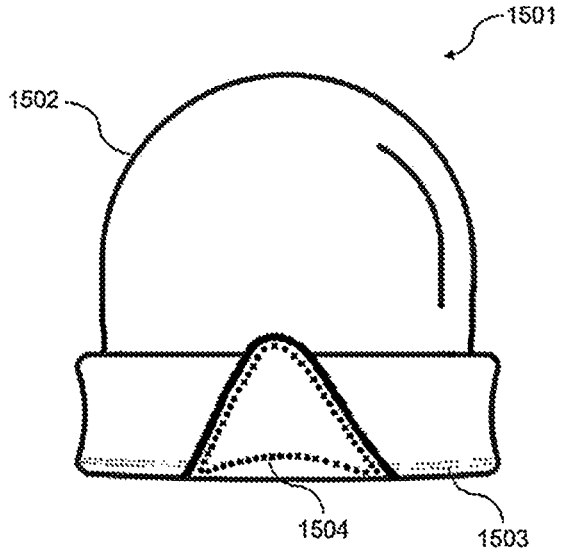
FIG. 15A is a front view of a knit hat with shark style enabled by the disclosed brim set, according to some embodiments of the present disclosure.
Figure 15B:
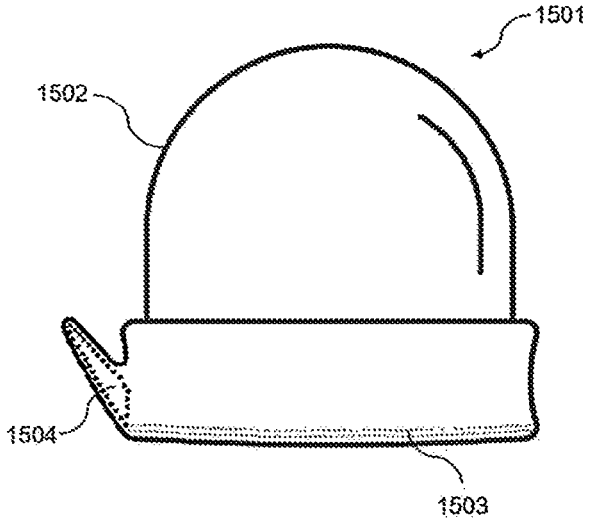
FIG. 15B is a side view of a knit hat with shark style enabled by the disclosed brim set, according to some embodiments of the present disclosure.
Figure 15C:
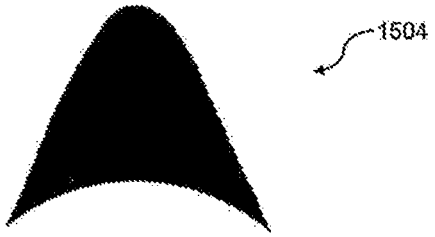
FIG. 15C is a brim attachment for a shark style of a brim set, according to some embodiments of the present disclosure.

FIG. 15A is a front view of a knit hat 1501 with a shark style. The shark style of a knit hat 1502 can be created with a shark brim set. A shark fin-styled brim attachment 1504 can be connected to an adjustable strap 1503 placed inside knit hat 1502. FIG. 15B is a side view of knit hat 1501 with a shark style. This side view can provide a better insight to the position of brim attachment 1504 connected to adjustable strap 1503. In some embodiments, brim attachment 1504 can be directly located on top of a wearer's forehead. In some embodiments, brim attachment 1504 can be positioned on the side of a wearer' head close to the ear. In some embodiments, brim attachment 1504 can be positioned on the back side of a wearer's head. FIG. 15C provides a specific view of brim attachment 1504 with the shark style, substantially mimicking the shape of a shark fin. In some embodiments, the shark style brim attachment can have a thickness of about 0.5 to 2 cm. Such a thickness for the shark style brim attachment can house at least three docks for purposes of connecting with a connector such as a latch, according to some embodiments of the present disclosure. The shark brim attachment can be a triangular visor that comes in the shape of an arrowhead.

Figure 16A:
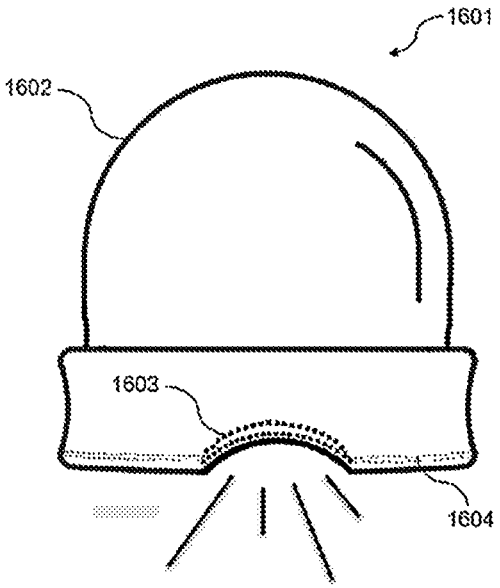
FIG. 16A is a front view of a knit hat with glow styling enabled by the disclosed brim set, according to some embodiments of the present disclosure.
Figure 16B:
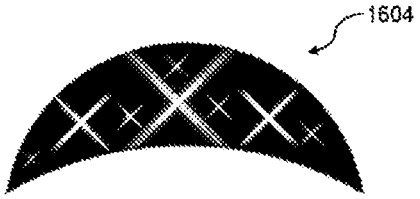
FIG. 16B is a brim attachment for a glow styling of a brim set, according to some embodiments of the present disclosure.

FIG. 16A is a front view of a knit hat 1601 with a glow styling enabled by the disclosed brim set, according to some embodiments of the present disclosure. The glow styling of a knit hat 1602 can be enabled by a brim attachment 1604 with a light source, which can be connected to an adjustable strap 1603. In some embodiments, when a person wears knit hat 1601, a light source-incorporating brim attachment 1604 can be positioned directly on top of the forehead. FIG. 16B provides a specific view of brim attachment 1604 with a light source to enable the glow style. Brim attachment 1604 can be placed in the annular space formed by folding up the edge of a knit hat, thus emitting light underneath the outer fabric of the knit hat. The light source is capable of displaying a variety of different colors. In some embodiments, the light source can include, but is not limited to, light bulb, lamp, light-emitting (LED), and organic light-emitting diode (OLED).

Figure 17A:
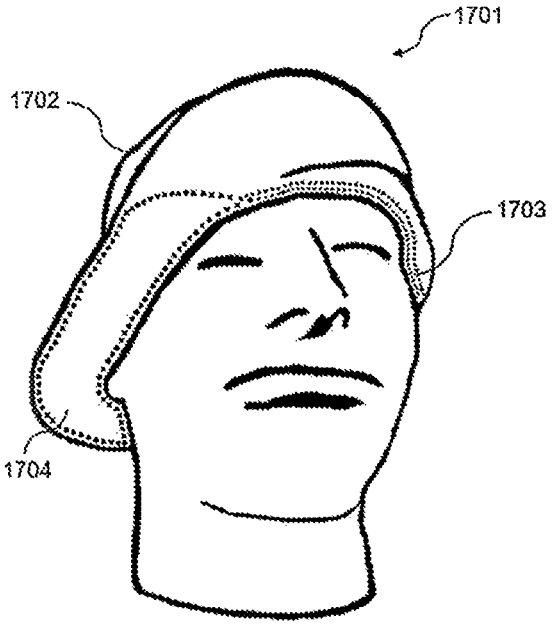
FIG. 17A illustrates a knit hat with Brooklyn style enabled by the disclosed brim set, according to some embodiments of the present disclosure.
Figure 17B:
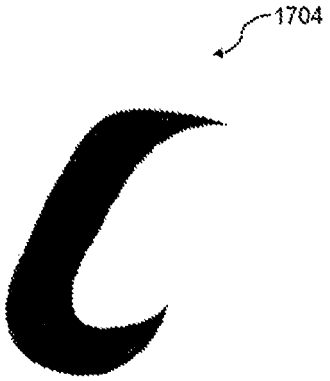
FIG. 17B is a brim attachment for a Brooklyn style of a brim set, according to some embodiments of the present disclosure.

FIG. 17A is illustrates a knit hat 1701 with a Brooklyn style. The Brooklyn style of a knit hat 1702 can be enabled by a brim attachment 1704 with a Brooklyn style, which can be connected to an adjustable strap 1703. In some embodiments, when a person wears knit hat 1701, Brooklyn-styled brim attachment 1704 can be positioned on one side of the head. FIG. 17B provides a specific view of brim attachment 1704 with the Brooklyn style. In some embodiments, the size of the Brooklyn can be about 1 inch (2.54 cm) wide, which can start from one side of a wearer's head and extend to the end of the ear. In some embodiments, the Brooklyn style brim attachment can have a thickness of about 0.5 to 2 cm. Such a thickness for the Brooklyn style brim attachment can house at least three docks on its side for purposes of connecting with a connector such as a latch, according to some embodiments of the present disclosure. In some embodiments, the Brooklyn brim attachment can take the shape of a lowercase letter "j" in backward. The brim attachment can protrude outward for about 1.27 cm in width from the temple area of the wearer's head and wrap around to the back of the neck.

Figure 18A:
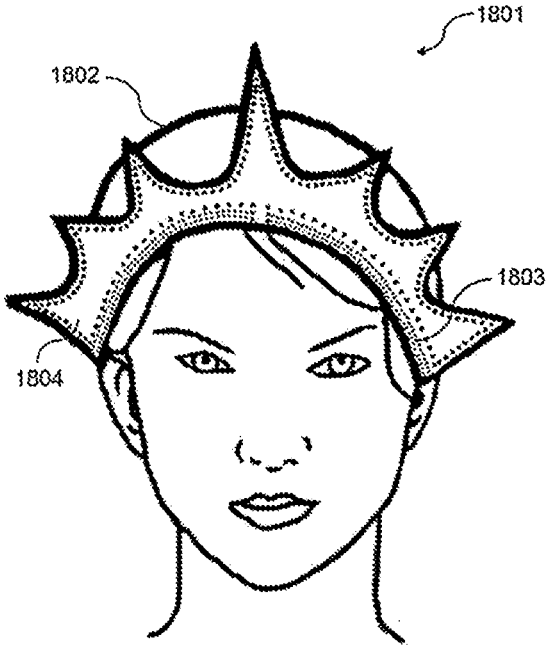
FIG. 18A is a front view of a knit hat with liberty style enabled by the disclosed brim set, according to some embodiments of the present disclosure.
Figure 18B:
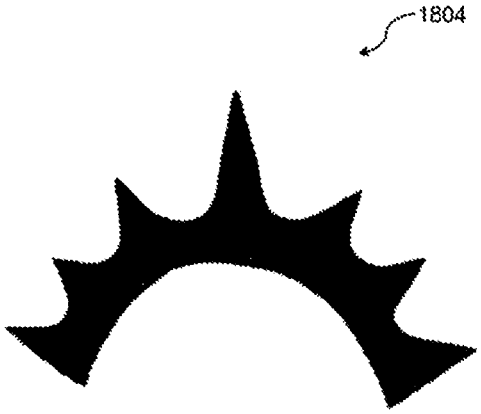
FIG. 18B is a brim attachment for a liberty style of a brim set, according to some embodiments of the present disclosure.

FIG. 18A is illustrates a knit hat 1801 with a liberty style. The liberty style of a knit hat 1802 can be created by a brim attachment 1804 substantially mimicking the Statute of Liberty tiara, which can be connected to an adjustable strap 1803. In some embodiments, when a person wears knit hat 1801, liberty-styled brim attachment 1804 can be positioned on one side of the head. FIG. 18B provides a specific view of brim attachment 1804 with the liberty style. In some embodiments, the liberty style brim attachment can have a thickness of about 0.5 to 2 cm. Such a thickness for the liberty style can house at least three docks on its side for purposes of connecting with a connector such as a latch, according to some embodiments of the present disclosure. In some embodiments, the liberty style brim attachment can have about 5, 6, 7, 8 or more evenly spaced elongated triangles that run along the forehead.

Figure 19A:
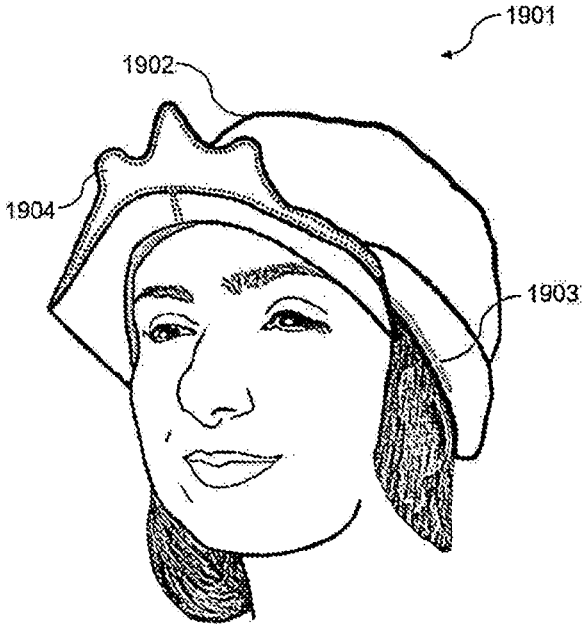
FIG. 19A is a front view of a knit hat with tiara style enabled by the disclosed brim set, according to some embodiments of the present disclosure.
Figure 19B:
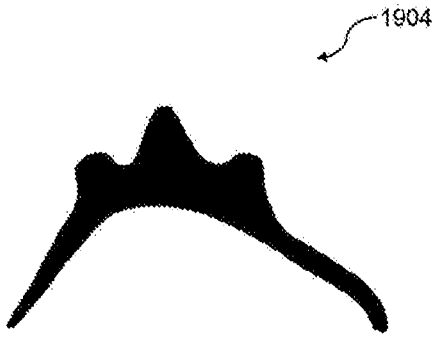
FIG. 19B is a brim attachment for a tiara style of a brim set, according to some embodiments of the present disclosure.

FIG. 19A is illustrates a knit hat 1901 with a tiara style. The tiara style of a knit hat 1902 can be created by a brim attachment 1904 substantially mimicking a typical tiara, which can be connected to an adjustable strap 1903. In some embodiments, when a person wears knit hat 1901, tiara-styled brim attachment 1904 can be positioned on one side of the head. FIG. 19B provides a specific view of brim attachment 1904 with the tiara style. In some embodiments, the tiara style brim attachment can have a thickness of about 0.5 to 2 cm. Such a thickness for the tiara style brim attachment can house at least three docks on its side for purposes of connecting with a connector such as a latch, according to some embodiments of the present disclosure. In some embodiments, the tiara brim attachment can take the form of a typical princess headpiece made up of a set of about three jewels. The middle piece can be the largest and resemble a pear-shaped jewel, while the other two smaller jewels on the sides can be in the shape of Marquise gems, in an oval shape.

Figure 20A:
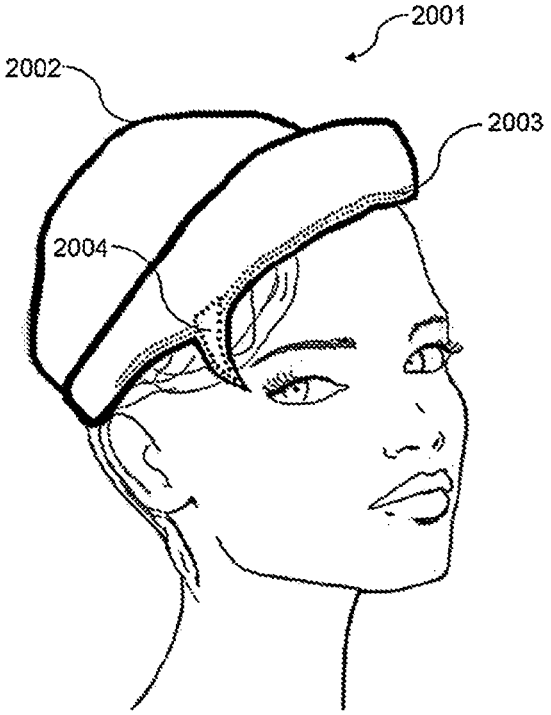
FIG. 20A is a front view of a knit hat with bird's eye styling enabled by the disclosed brim set, according to some embodiments of the present disclosure.
Figure 20B:
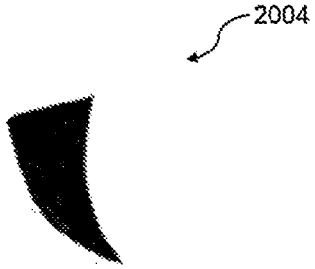
FIG. 20B is a brim attachment for a bird's eye styling of a brim set, according to some embodiments of the present disclosure.

FIG. 20A is illustrates a knit hat 2001 with a bird's eye styling. The bird's eye style of a knit hat 2002 can be created by a brim attachment 2004, which can be connected to an adjustable strap 2003. In some embodiments, when a person wears knit hat 2001, bird's eye-styled brim attachment 2004 can be positioned on one side of the head. FIG. 20B provides a specific view of brim attachment 2004 with the bird's eye style. In some embodiments, bird's eye can be a hook-shaped brim attachment that is intended to highlight the wearer's eye. In some embodiments, the bird's eye style brim attachment can have a thickness of about 0.5 to 2 cm. Such a thickness for the bird's eye style brim attachment can at least house three docks on its side for purposes of connecting with a connector such as a latch, according to some embodiments of the present disclosure. In some embodiments, the bird's eye brim attachment can take the shape of a tiger's claw, but may not be as pointed at the tip.

Figure 21A:
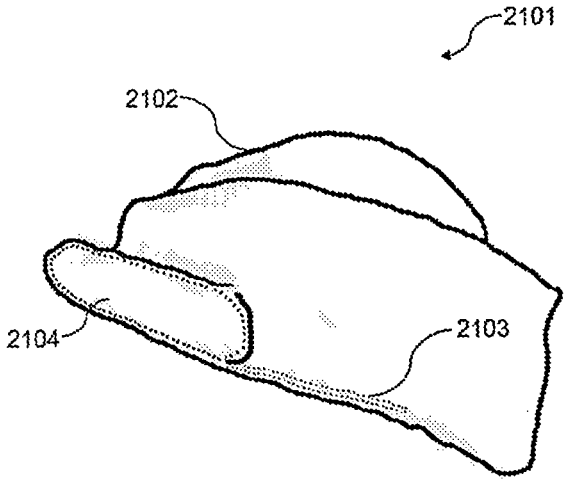
FIG. 21A is a front view of a knit hat with butterman styling enabled by the disclosed brim set, according to some embodiments of the present disclosure.
Figure 21B:
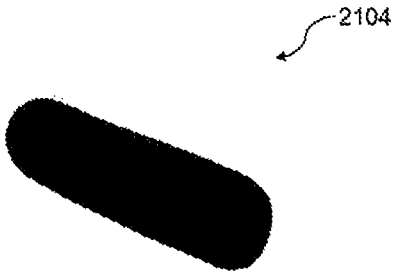
FIG. 21B is a brim attachment for a butterman styling of a brim set, according to some embodiments of the present disclosure.

FIG. 21A is illustrates a knit hat 2101 with a butterman styling. The butterman style of a knit hat 2102 can be created by a brim attachment 2104, which can be connected to an adjustable strap 2103. In some embodiments, when a person wears knit hat 2101, butterman-styled brim attachment 2104 can be positioned on one side of the head. FIG. 21B provides a specific view of brim attachment 2104 with the butterman style. In some embodiments, the brim attachment in butterman style can resemble a wide horseshoe with the front end bent slightly upward. In some embodiments, the butterman style brim attachment can have an extra thick "c"-shaped frame extending from one ear to the other. The center of the brim can slant slightly upward, giving its wearer the look of a contemporary construction worker.

Figure 22A:
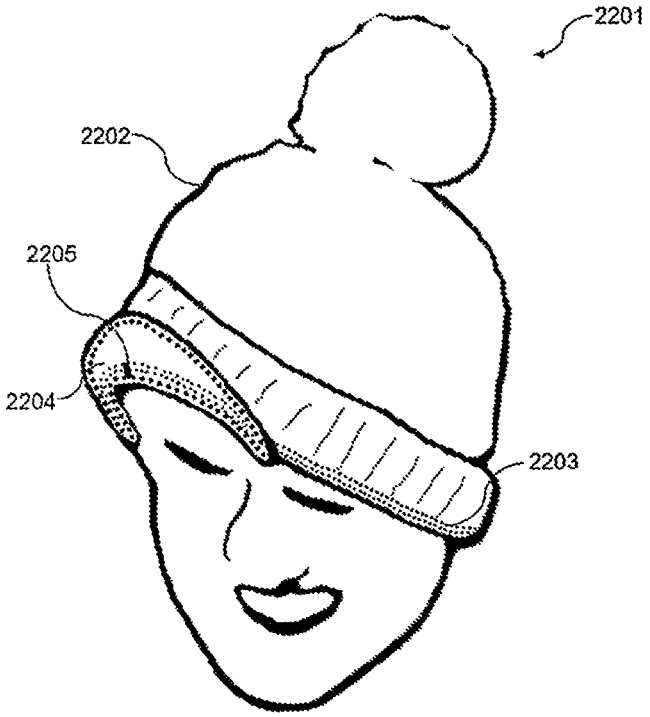
FIG. 22A is a front view of a knit hat with turtle styling enabled by the disclosed brim set, according to some embodiments of the present disclosure.
Figure 22B:
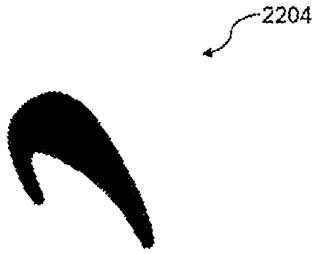
FIG. 22B is a brim attachment for a turtle styling of a brim set, according to some embodiments of the present disclosure.

FIG. 22A is illustrates a knit hat 2201 with a turtle styling. The turtle style of a knit hat 2202 can be created by a brim attachment 2204, which can be connected to an adjustable strap 2203 via a connector such as a latch 2205 illustrated in this embodiment. In some embodiments, when a person wears knit hat 2201, turtle-styled brim attachment 2204 can be positioned on one side of the head. FIG. 22B provides a specific view of brim attachment 2204 with the turtle style. In some embodiments, the brim attachment in turtle style can provide the appearance of a turtle shell. This brim style can highlight the wearer's face and have similarities to a tortoise. In some embodiments, the turtle style brim attachment can have a thickness of about 0.5 to 2 cm. Such a thickness for the turtle style brim attachment can house at least three docks on its side for purposes of connecting with a connector such as a latch, according to some embodiments of the present disclosure.

Figure 23A:
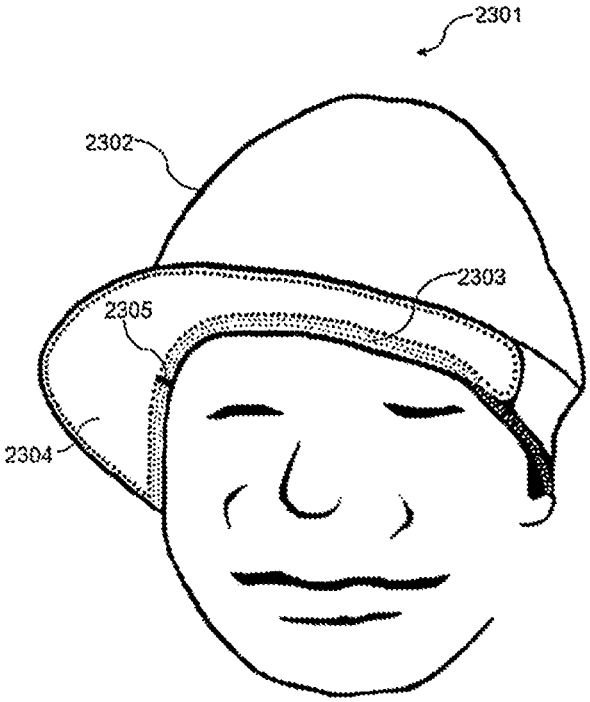
FIG. 23A is a front view of a knit hat with Huckleberry Finn styling enabled by the disclosed brim set, according to some embodiments of the present disclosure.
Figure 23B:
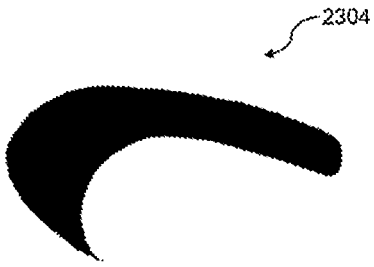
FIG. 23B is a brim attachment for a Huckleberry Finn styling of a brim set, according to some embodiments of the present disclosure.

FIG. 23A is illustrates a knit hat 2301 with a Huckleberry Finn styling. The Huckleberry Finn style of a knit hat 2302 can be created by a brim attachment 2304, which can be connected to an adjustable strap 2303 via a connector such as a latch 2305 illustrated in this embodiment. In some embodiments, when a person wears knit hat 2301, Huckleberry Finn-styled brim attachment 2304 can be positioned on one side of the head. FIG. 23B provides a specific view of brim attachment 2304 with the Huckleberry Finn style. In some embodiments, the Huckleberry Finn is a boomerang type shaped brim that is designed to conform along and around the side of a wearer's head. The protruding off-centered brim style design can give a fashion look of old classic America. In some embodiments, the Huckleberry Finn style brim attachment can have a thickness of about 0.5 to 2 cm. Such a thickness for the Huckleberry Finn style brim attachment can house at least three docks one the side for purposes of connecting with a connector such as a latch, according to some embodiments of the present disclosure.

Figure 24:
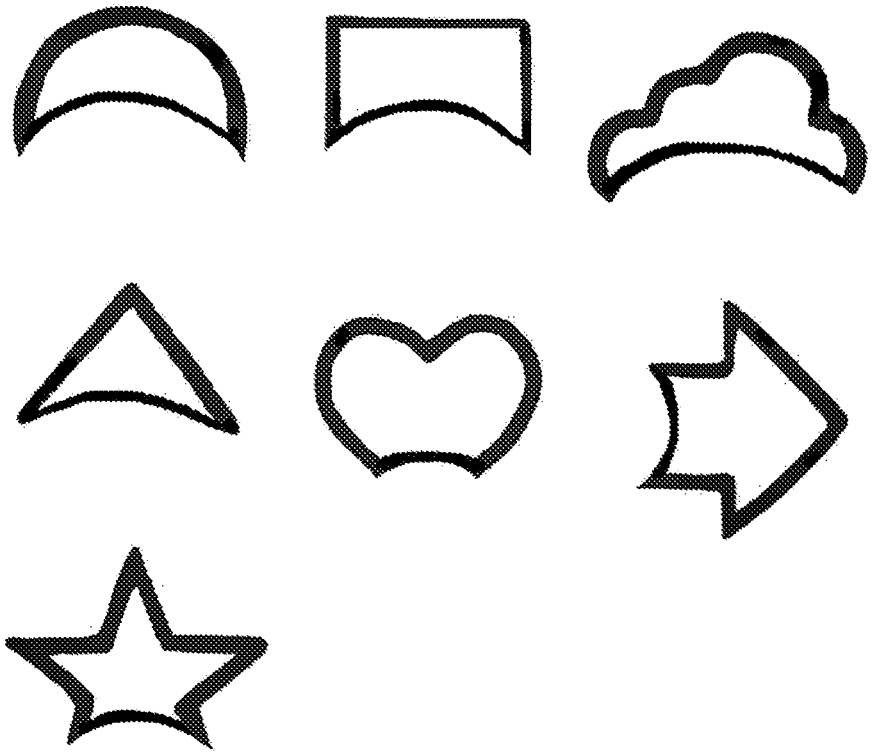
FIG. 24 illustrates a collection of secondary miniature brim attachment, according to some embodiments of the present disclosure.

The brim attachments illustrated in FIGS. 1 and 5-23 represent embodiments of primary brim attachments. FIG. 24 illustrates a collection of secondary miniature brim attachments. The secondary miniature brim attachments can be used in combination with the primary brim attachments discussed in the above sections, enabling extra style options for the user. It is contemplated that docks can be made in the secondary miniature brim attachments for purposes of connecting with a connector such as a latch as illustrated in FIG. 2.

In the embodiments illustrated in FIGS. 1 and 5-24, a substantial portion or all of the brim attachment can be placed between the annular space formed between inner fabric and outer fabric of a knit hat, the brim attachment will not be seen and merely for purposes of forming a visor portion by protruding part of the outer fabric. In some embodiments, the brim attachment can be designed to extend from the annular space formed by the inner fabric and outer fabric, a portion of the brim attachment can be seen by observers. In some embodiments, a Halloween collection can be designed to include brim attachments in a variety of different shapes to be exposed outside for purposes of a Halloween costume. A set of brim attachments substantially mimicking the shape of ears can be affixed onto the adjustable strap. The shape of the brim attachments can include, but not limited to, dog ear, Orge ear, and devil ear. In some embodiments, the adjustable strap, connector, and positioning of the brim set can be the same as illustrated in FIGS. 1-24, except for the special ear shape the partial exposure of the brim attachment. This configuration can be illustrated in FIGS. 25-27 below.

Figure 25A:
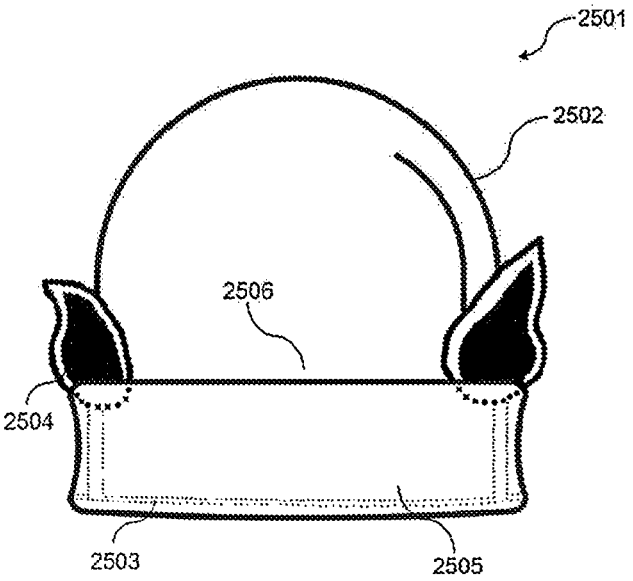
FIG. 25A is a front view of a knit hat with a dog style enabled by the disclosed brim set, according to some embodiments of the present disclosure.
Figure 25B:
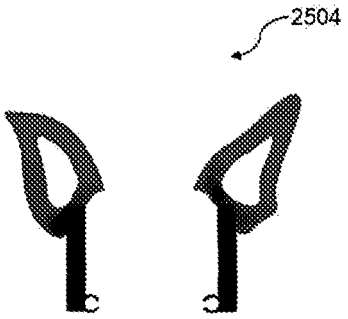
FIG. 25B is a brim attachment for a dog style of a brim set, according to some embodiments of the present disclosure.

FIG. 25A is a front view of a knit hat 2501 with a dog style, according to some embodiments of the present disclosure. The bottom portion of a knit hat 2502 can be folded up when worn by a user, this creates a channel between outer knit fabric 2505 and inner knit fabric 2506, which can be used for the placement of the brim set in the present disclosure for purposes of enabling different styles. The dog style of knit hat 2502 can be enabled by two brim attachments 2504 substantially mimicking the shape of a dog ear, which can be connected to an adjustable strap 2503. In some embodiments, when a person wears knit hat 2501, dog ear shaped brim attachments 2504 can be located close to the wear's ears. FIG. 25B provides a specific view of brim attachment 2504 with a shape of dog ear.

Figure 26A:
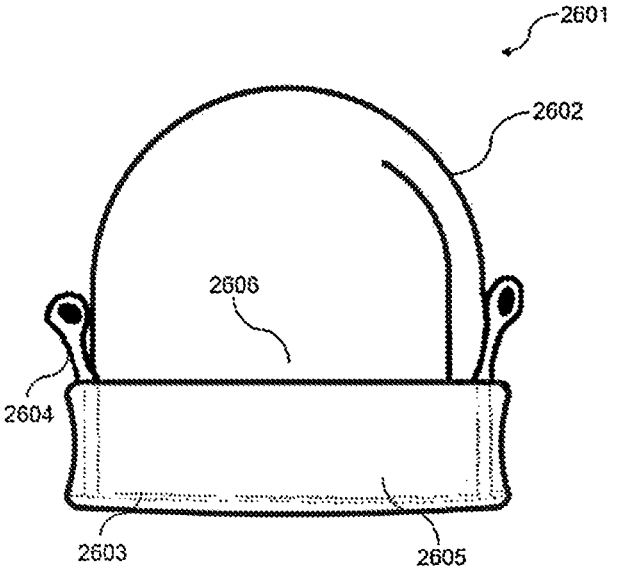
FIG. 26A is a front view of a knit hat with an Orge style enabled by the disclosed brim set, according to some embodiments of the present disclosure.
Figure 26B:
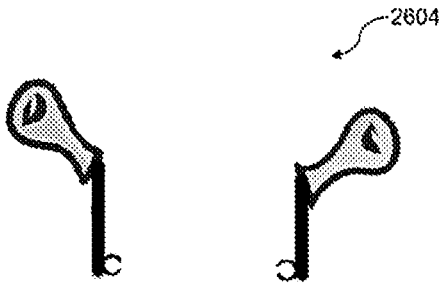
FIG. 26B is a brim attachment for an Orge style of a brim set, according to some embodiments of the present disclosure.

FIG. 26A is a front view of a knit hat 2601 with an Orge style, according to some embodiments of the present disclosure. The bottom portion of a knit hat 2602 can be folded up when worn by a user, this creates a channel between outer knit fabric 2605 and inner knit fabric 2606, which can be used for the placement of the brim set in the present disclosure for purposes of enabling different style. The Orge style of knit hat 2602 can be enabled by two brim attachments 2604 substantially mimicking the shape of an ear for Orge, which can be connected to an adjustable strap 603. In some embodiments, when a person wears knit hat 2601, Orge ear shaped brim attachments 2604 can be located close to the wear's ears. FIG. 26B provides a specific view of brim attachment 2604 with a shape of Orge ear.

Figure 27A:
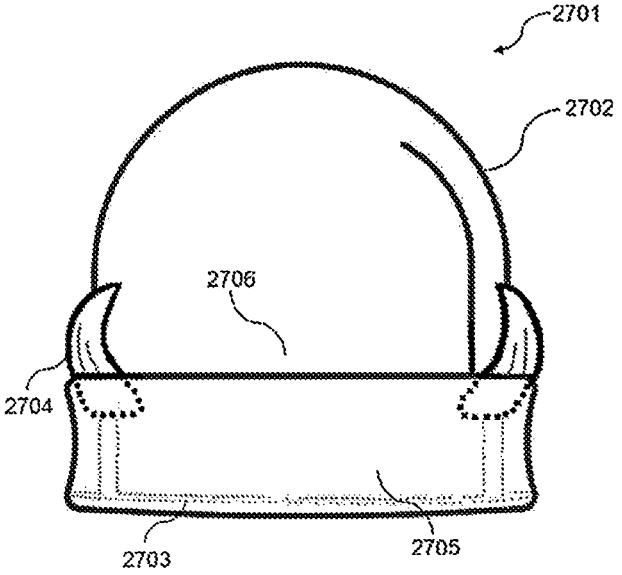
FIG. 27A is a front view of a knit hat with a devil style enabled by the disclosed brim set, according to some embodiments of the present disclosure.
Figure 27B:
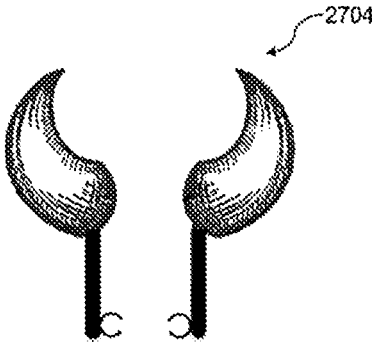
FIG. 27B is a brim attachment for a devil style of a brim set, according to some embodiments of the present disclosure.

FIG. 27A is a front view of a knit hat 2701 with an devil style, according to some embodiments of the present disclosure. The bottom portion of a knit hat 2702 can be folded up when worn by a user, this creates a channel between outer knit fabric 2705 and inner knit fabric 2706, which can be used for the placement of the brim set in the present disclosure for purposes of enabling different styles. The devil style of knit hat 2702 can be enabled by two brim attachments 2704 substantially mimicking the shape of a devil's ear, which can be connected to an adjustable strap 2703. In some embodiments, when a person wears knit hat 2701, devil's ear shaped brim attachments 2704 can be located close to the wear's ears. FIG. 27B provides a specific view of brim attachment 2704 with a shape of devil's ear.

Figure 28:
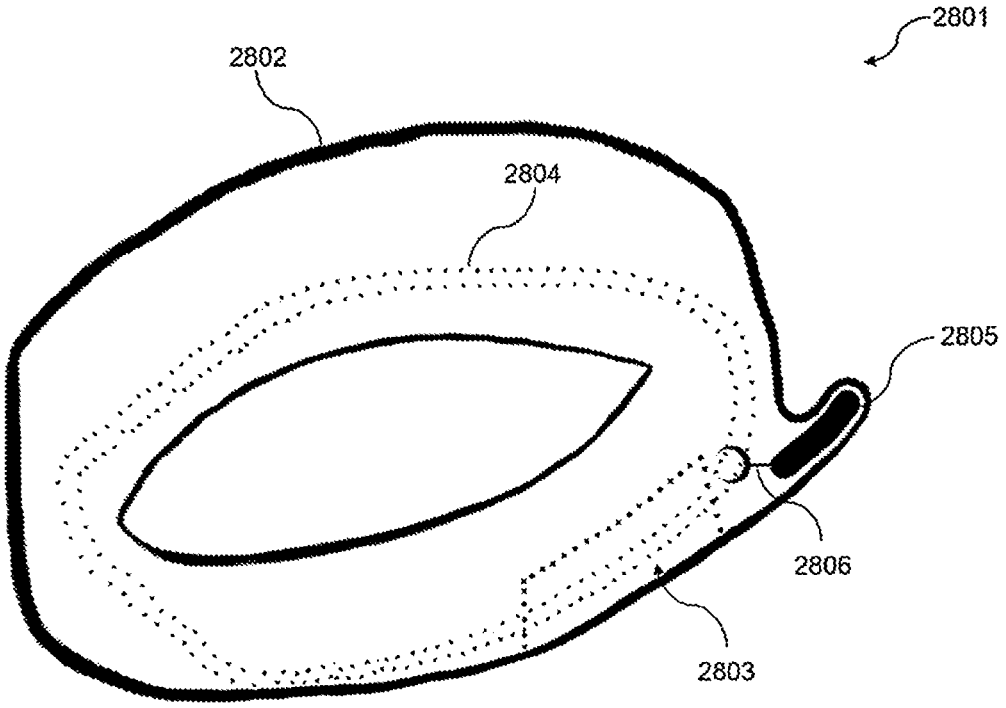
FIG. 28 illustrates the use of a brim set in a sweatband or headband, according to some embodiments of the present disclosure.

FIG. 28 illustrates the use of a brim set in a sweatband or headband 2801, according to some embodiments of the present disclosure. A sweatband or headband 2802 can comprise two layers of fabrics with a slit 2803, which can accommodate a brim set as described herein. A slit 2803 can be open or sealed via locking mechanisms including, but are not limited to, hook and loop fasteners (e.g., VELCRO®), button, buckle, clip, clamp, magnet, and zipper. An adjustable strap 2804 of a brim set can be inserted through the slit 2803 to extend throughout sweatband or headband 2802. A connector 2806 can be used to connect a brim attachment 2805 onto adjustable strap 2804 for purposes of enabling different shapes or styles. In some embodiments, to adapt to the relatively small fabric piece of sweatband or headband 2802, brim attachment 2805 can be, for example, secondary miniature brim attachments as illustrated in FIG. 24 or a nub brim attachment as illustrated in FIG. 10. In some embodiments, an adjustable strap 2804 can include an inner space (not depicted in the figure), which can be filled with cooling agents. This can provide a cooling function during warm conditions for the wearer of any brim set and hat, sweatband, or headband combination.

For the purposes of this specification and appended claims, unless otherwise indicated, all numbers expressing quantities of ingredients, percentages or proportions of materials, reaction conditions, and other numerical values used in the specification and claims, are to be understood as being modified in all instances by the term "about." Similarly, when values are expressed as approximations, by use of the antecedent "about," it will be understood that the particular value forms another embodiment that is +/−10% of the recited value. Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Ranges may be expressed herein as from "about" or "approximately" one particular value and/or to "about" or "approximately" another particular value. When such a range is expressed, another embodiment includes from the one particular value and/or to the other particular value.

As used in the specification and including the appended claims, the singular forms "a," "an," and "the" include the plural, and reference to a particular numerical value includes at least that particular value, unless the context clearly dictates otherwise.

The term "substantially" (or alternatively "substantial") is meant to permit deviations from the descriptive term that don't negatively impact the intended purpose.

The embodiments illustratively described herein suitably can be practiced in the absence of any element or elements, limitation or limitations that are specifically or not specifically disclosed herein. Thus, for example, in each instance herein any of the terms "comprising", "consisting essentially of", and "consisting of" may be replaced with either of the other two terms, while retaining their ordinary meanings. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by embodiments, optional features, modification and variation of the concepts herein disclosed may be resorted to by those skilled in the art, and that such modifications and variations are considered to be within the scope of this invention as defined by the description and the appended claims.

Any single term, single element, single phrase, group of terms, group of phrases, or group of elements described herein can be specifically excluded from the claims.

Whenever a range is given in the specification, for example, a temperature range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the aspects herein. It will be understood that any elements or steps that are included in the description herein can be excluded from the claimed compositions or methods.

In addition, where features or aspects of the invention are described in terms of Markush groups or other grouping of alternatives, those skilled in the art will recognize that the invention is also thereby described in terms of any individual member or subgroup of members of the Markush group or other group.

While the disclosure has been described in connection with certain embodiments, it is to be understood that the disclosure is not to be limited to the disclosed embodiments but, on the contrary, is intended to cover various modifications and equivalent arrangements included within the spirit and scope of the disclosure, which scope is to be accorded the broadest interpretation so as to encompass all such modifications and equivalent structures as is permitted under the law.

What is claimed is:

1. A brim set for a knit hat, the brim set comprising:

an adjustable strap in a circular shape;

at least one removeable brim attachment, and a two-way connector connecting the at least one brim attachment onto the adjustable strap;

wherein the adjustable strap is configured to be housed in an annular space formed between an inner fabric and an outer fabric of a folded-up brim of the knit hat;

wherein the adjustable strap is immobilized directly inside a crease that intersects the inner fabric and the outer fabric and configured such that the adjustable strap provides an anchoring point for the brim attachment;

wherein the at least one brim attachment is reversible and positionable;

wherein the two-way connector is a latch;

wherein the latch comprises a rod and a clip, wherein the rod engages at least one dock of the brim attachment and the clip engages the adjustable strap; and wherein the at least one dock comprises two or more docks having different depths such that, when the rod is inserted into different ones of the two or more docks, an effective length of the rod is changed thereby changing a distance between the adjustable strap and the at least one brim attachment.

2. The brim set according to claim 1, wherein the at least one brim attachment comprises two or more brim attachments, wherein each of the two or more brim attachments are connectable to the adjustable strap by the two-way connector.

3. The brim set according to claim 1, wherein the brim attachment comprises a light source.

4. The brim set according to claim 3, wherein the light source is capable of displaying a variety of different colors.

5. The brim set according to claim 1, wherein the adjustable strap comprises a frame and a fastener.

6. The brim set according to claim 5, wherein the adjustable strap comprises a plurality of pegs on the frame and a plurality of perforations on the fastener that cooperate to adjust a size of the adjustable strap.

7. The brim set according to claim 5, wherein the fastener comprises a bead section and a tube section configured to adjust a size of the adjustable strap.

8. The brim set according to claim 1, wherein the two or more docks provide for the distance of about 0.4 to 1.5 cm between the brim attachment and the adjustable strap.

9. The brim set according to claim 1, wherein the two or more docks provide for the distance of about 2.0 to 3.1 cm between the brim attachment and the adjustable strap.

10. The brim set according to claim 1, wherein the two or more docks provide for the distance of about 3.3 to 3.8 cm between the brim attachment and the adjustable strap.

11. The brim set according to claim 1, wherein the adjustable strap comprises an inner space.

12. The brim set according to claim 11, wherein inner space is filled with a cooling element or a warming element.

13. The brim set according to claim 1, wherein the adjustable strap, the brim attachment, or both the adjustable strap and brim attachment are made of a plastic material.

14. A knit hat comprising a brim set present in an annular space between an inner fabric and an outer fabric of the knit hat formed by folding up an edge of the knit hat, wherein the brim set comprises:

an adjustable strap in a circular shape;

a removable brim attachment; and a two-way connector configured to connect the brim attachment onto the adjustable strap;

wherein the adjustable strap is immobilized directly inside a crease that intersects the inner fabric and the outer fabric and configured such that the adjustable strap provides an anchoring point for the brim attachment;

wherein the at least one brim attachment is reversible and positionable;

wherein the two-way connector is a latch;

wherein the latch comprises a rod and a clip, wherein the rod engages at least one dock of the brim attachment and the clip engages the adjustable strap; and wherein the at least one dock comprises two or more docks having different depths such that, when the rod is inserted into different ones of the two or more docks, an effective length of the rod is changed thereby changing a distance between the adjustable strap and the at least one brim attachment.

* * * * *